US009672800B2

(12) United States Patent
Gozzi

(10) Patent No.: US 9,672,800 B2
(45) Date of Patent: Jun. 6, 2017

(54) AUTOMATIC COMPOSER

(71) Applicant: APPLE INC., Cupertino, CA (US)

(72) Inventor: Andrea Gozzi, Hamburg (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/871,271

(22) Filed: Sep. 30, 2015

(65) Prior Publication Data

US 2017/0092248 A1 Mar. 30, 2017

(51) Int. Cl.

*G10H 1/22* (2006.01)
*G10H 7/00* (2006.01)
*G10H 1/00* (2006.01)

(52) U.S. Cl.

CPC ..... *G10H 1/0025* (2013.01); *G10H 2210/031* (2013.01); *G10H 2210/111* (2013.01); *G10H 2210/125* (2013.01)

(58) Field of Classification Search

CPC ..... G10H 1/0025; G10H 2210/111; G10H 2210/125; G10H 2210/031
USPC ..... 84/618
See application file for complete search history.

(56) References Cited

U.S. PATENT DOCUMENTS 5,424,486 A 6/1995 Aoki
6,225,546 B1 * 5/2001 Kraft ..... G10H 1/00 700/94
7,732,697 B1 * 6/2010 Wieder ..... G10H 1/0025 84/609
8,044,290 B2 * 10/2011 Kwon ..... G10H 1/0008 700/94
8,283,548 B2 * 10/2012 Oertl ..... G10H 1/0066 84/609
9,117,432 B2 8/2015 Makamura
2007/0289434 A1 12/2007 Yamada et al.
2008/0209484 A1 * 8/2008 Xu ..... G06F 17/30787 725/105
2011/0112672 A1 * 5/2011 Brown ..... G10H 1/0025 700/94
2012/0312145 A1 * 12/2012 Kellett ..... G10H 1/38 84/613
2013/0275421 A1 * 10/2013 Resch ..... G10H 1/0008 707/725

(Continued)

OTHER PUBLICATIONS

Non-Final Office Action mailed Aug. 26, 2016 for U.S. Appl. No. 14/871,902, filed Sep. 30, 2015; all pages.

*Primary Examiner* — Jeffrey Donels
(74) *Attorney, Agent, or Firm* — Kilpatrick Townsend & Stockton LLP

(57) ABSTRACT

Methods and apparatuses are disclosed for automatically composing a song are disclosed. In an embodiment, a method includes receiving music performance data by a processor. The processor may then segment the music performance data based on at least one structural attribute into at least a first musical segment, where the first musical segment is associated with at least one musical attribute. The processor may then determine an affinity value for the first musical segment based on the at least one musical attribute. The affinity value represents a degree of similarity between the first musical segment and a second musical segment having the at least one musical attribute. The processor may then generate a musical composition based on the affinity values associated with the first musical segment and the second musical segment.

19 Claims, 20 Drawing Sheets

(56) References Cited

U.S. PATENT DOCUMENTS

| | | | | |
|---|---|---|---|---|
| 2014/0260909 | A1 | 9/2014 | Matusiak et al. | |
| 2014/0330556 | A1* | 11/2014 | Resch | G10L 19/00 704/221 |
| 2014/0338515 | A1* | 11/2014 | Sheffer | G10H 1/36 84/609 |
| 2016/0148604 | A1 | 5/2016 | Minamitaka | |

* cited by examiner

AUTOMATIC COMPOSER

CROSS-REFERENCES TO RELATED APPLICATIONS

The following regular U.S. patent applications are being filed concurrently, and the entire disclosure of the other applications are incorporated by reference into this application for all purposes:

- Application Ser. No. 14/871,978, filed Sep. 30, 2015, entitled "Automatic Music Recording and Authoring Tool";
- Application Ser. No. 14/871,982, filed Sep. 30, 2015, entitled "Automatic Music Recording and Authoring Tool";
- Application Ser. No. 14/871,902, filed Sep. 30, 2015, entitled "MUSIC ANALYSIS PLATFORM"; and
- Application Ser. No. 14/871,897, filed Sep. 30, 2015, entitled "MUSIC ANALYSIS PLATFORM".

BACKGROUND

Musical compositions are pieces of musical work that contain an arrangement of melody, harmony, and rhythm. Creators of such musical compositions are known as composers, who decide how the melody, harmony, and rhythm are arranged. Modern technology has advanced to assist composers in developing musical compositions. For instance, software applications have been developed to provide composers an interface with which musical pieces may be constructed and sampled (e.g., heard by the composer) in real time. These types of software applications perform calculations on a digital representation of a musical piece which may be referred to as "music performance data." The music performance data may then be manipulated by such software applications. Often, composers utilize modern technology to develop music compositions from beginning to end in one progression. Despite these technological advances, however, modern technology limits composers' abilities to experience different variations of their work, thereby stifling their creative potential. Accordingly, improvements to such modern technology are desired.

SUMMARY

Embodiments provide methods and systems for automatically generating a musical composition from music performance data to provide an interactive way of inspiring a composer to create musical pieces.

In some embodiments, a method includes receiving, by a processor, music performance data, and segmenting, by the processor, the music performance data based on at least one structural attribute into at least a first musical segment. The first musical segment may be associated with at least one musical attribute. Also, the first musical segment may have at least one of a corresponding prologue, epilogue, and verse. The method may include determining, by the processor, an affinity value for the first musical segment based on the at least one musical attribute. The affinity value may represent a degree of similarity between the first musical segment and a second musical segment having the at least one musical attribute. The method may further include generating, by the processor, a musical composition based on the affinity values associated with the first musical segment and the second musical segment.

In certain embodiments, a non-statutory computer-readable medium having a computer-readable program code configured to cause a processor to perform operations including receiving music performance data and analysis data, and segmenting the music performance data based on at least one structural attribute into at least a first musical segment. The first musical segment may be associated with at least one musical attribute. Additionally, the first musical segment may have at least one of a corresponding prologue, epilogue, and verse. The operations may include determining an affinity value for the first musical segment based on the at least one musical attribute. The affinity value may represent a degree of similarity between the first musical segment and a second musical segment having the at least one musical attribute. The operations may further include generating a musical composition based on the affinity values associated with the first musical segment and the second musical segment.

In some embodiments, a system may include a user interface, one or more data processors coupled to the user interface, and one or more non-transitory computer-readable storage media containing instructions configured to cause the one or more data processors to perform operations including receiving music performance data and analysis data, and segmenting the music performance data based on at least one structural attribute into at least a first musical segment. The first musical segment may be associated with at least one musical attribute. Additionally, the first musical segment may have at least one of a corresponding prologue, epilogue, and verse. The operations may include determining an affinity value for the first musical segment based on the at least one musical attribute. The affinity value may represent a degree of similarity between the first musical segment and a second musical segment having the at least one musical attribute. The operations may further include generating a musical composition based on the affinity values associated with the first musical segment and the second musical segment, and presenting the musical composition to the user interface.

A better understanding of the nature and advantages of embodiments of the present invention may be gained with reference to the following detailed description and the accompanying drawings.

DETAILED DESCRIPTION

Embodiments describe a method and system for an automatic composer, which can be configured to automatically generate a musical composition from music performance data, or assist the user in re-composing that music performance data. Music performance data may be one or more representations of sound. For instance, music performance data may be a piece of music in the form of a digital recording. The automatic composer may utilize the music performance data to generate a musical composition. The musical composition may include musical segments that are arranged differently than when the musical segments were originally arranged in the music performance data. In embodiments, the generated musical composition may be presented to a user, e.g, played and/or modified and/or displayed to the user.

To generate a musical composition, an automatic composer may segment music performance data into one or more musical segments according to embodiments of the present invention. Each musical segment may then be assigned information pertaining to its musical profile. For instance, an affinity value representing a degree of similarity between two musical segments may be calculated and assigned to each of the two musical segments. Depending on the affinity value, the musical segments may then paired with one another to form a part of, or an entire, musical composition. The musical composition may be generated without extensive interaction from a user.

Embodiments allow a user to automatically create musical compositions. The user does not need to manually segment music performance data into musical segments by hand, nor does the user need to manually recompose the musical segments together into a musical composition. Additionally, the recomposed musical segments may have similar musical sound such that the musical composition is a cohesive musical piece. As a result, embodiments may save the user a substantial amount of time and effort, while also allowing the user to modify music performance data in various ways that were not originally imagined.

I. Audio Processing System

The automatic composer, according to embodiments, may be part of a post-processing system for an audio processing system. That is, the automatic composer may receive data from the audio processing system, and may utilize that data to automatically generate musical compositions, according to embodiments of the present invention. To better understand how the automatic composer plays a role in a larger system, the audio processing system will be discussed herein.

Figure 1:
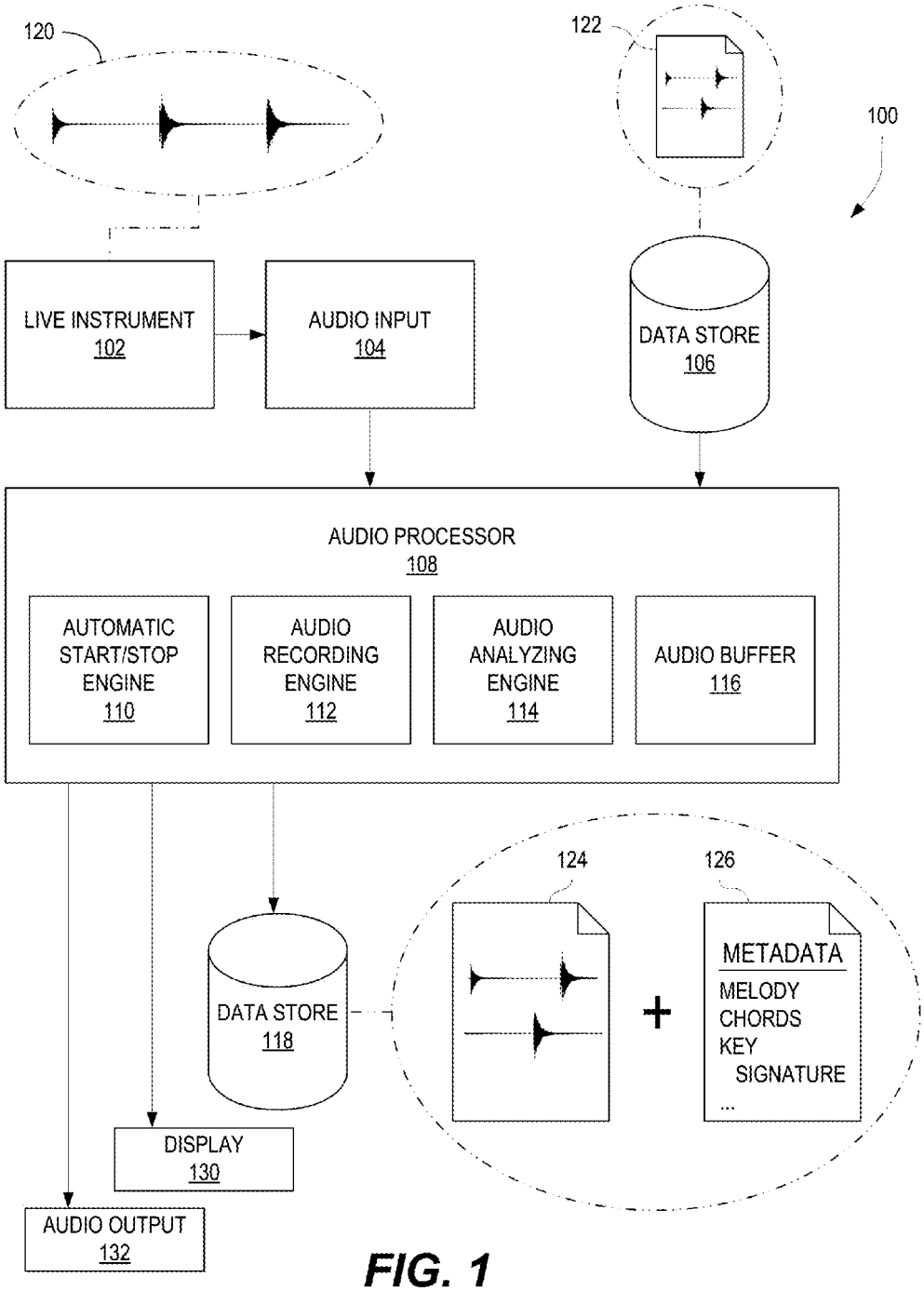
FIG. 1 is a schematic diagram illustrating an audio processing system, according to embodiments of the present invention.

FIG. 1 is a schematic diagram depicting an audio processing system 100 according to certain aspects of the present disclosure. The audio processing system 100 can be embodied in one or more pieces of hardware, such as a single device (e.g., smartphone or computer), multiple devices directly coupled together (e.g., a rack of equipment), multiple devices remotely coupled together (e.g., multiple computers communicatively coupled together via a network), or any combination thereof. The audio processing system 100 can include an audio processor 108 capable of accessing audio data. Audio data can include any data received by the audio processor 108 that is representative of a sound. Audio data can be provided as an audio signal 120 or an audio file 122.

An audio signal 120 can be any analog or digital signal being performed or created in real time. In some cases, audio signals 120 can be created by a live instrument 102 and provided to the audio processor 108 through an audio input 104. In some cases, audio signals 120 can be sound waves originating from a live instrument 102 (e.g., an acoustic guitar, a piano, a violin, a flute, or other traditional or non-traditional instrument capable of producing sound waves) that are picked up by an audio input 104 that is a microphone (e.g., a dynamic microphone, condenser microphone, ribbon microphone, fiber optic microphone, condenser microphone, hydrophone, or any other device capable of generating an electrical signal representative of a sound wave). In some cases, audio signals 120 can originate from voice (e.g., a singer or chorus), speakers (e.g., a pre-recorded sound or a live-played sound), nature-based sounds (e.g., wind noises or water noises), or other sources besides traditional instruments which can be received by an audio input 104 that is a microphone.

In some cases, audio signals 120 can be analog electrical signals originating from a live instrument 102 (e.g., electric guitar, electric piano, electric violin, Theremin, or other traditional or non-traditional instrument capable of producing an electrical signal corresponding to a sound wave) and received by an audio input 104 that is a line input.

In some cases, audio signals 120 can be digital signals originating from a live instrument 102 (e.g., a Musical Instrument Digital Interface (MIDI) controller, a computer-based digital instrument, or other traditional or non-traditional instrument capable of producing a digital signal representative of a sound wave) and received by an audio input 104 that is a digital signal processor. In some cases, audio signals 120 that are digital signals can be provided directly to the audio processor 108.

In some cases, other equipment, such as preamplifiers, digital signal processors, compressors, analog-to-digital converters, and the like, can be included as part of the audio input 104 or coupled between the audio input 104 and the audio processor 108.

In addition to or instead of receiving an audio signal 120, the audio processor 108 can receive audio data in the form or an audio file 122. Audio file 122 can be any audio data stored in a file that is representative of an audio signal 120, such as a waveform audio file, Moving Picture Experts Group (MPEG)-1 or MPEG 2 Audio Layer III (MP3) file, Apple Lossless Audio Codec (ALAC), or any other file containing audio data. In some cases, an audio file 122 can be included in a file containing more than just audio data, such as a video file or other file. The audio file 122 can be stored on a data store 106. Data store 106 can be any storage medium accessible to the audio processor 108, such as built-in memory (e.g., flash storage in a smartphone), external memory (e.g., an external hard drive of a computer), or remotely accessible memory (e.g., a hard drive of a computer accessible to the audio processor 108 via a network, such as the internet). In some cases, an audio file 122 can be generated in real time (e.g., by a computer-based instrument) and need not be previously stored in a data store prior to being provided to the audio processor 108.

In some cases, the audio file 122 is a streaming file that is provided to the audio processor 108 through a communication link, such as a wireless or wired network connection. The streaming file can originate from a remote source, such as a recording device placed a distance from the audio processor 108 or a server accessible through a network (e.g., the Internet). In an example, a smartphone can act as a recording device and can be coupled to a computer via a communication link (e.g., WiFi or Bluetooth connection), where the computer acts as the audio processor 108. In that example, the smartphone can receive audio signals 120 at a microphone and store the audio signals as an audio file 122 which can be transmitted to the computer for further processing.

The audio processor 108 can process any incoming audio data. The audio processor 108 can include one or more of an automatic start/stop engine 110, an audio recording engine 112, an audio analyzing engine 114, and an audio buffer 116. The audio processor 108 can include more or fewer components. The audio processor 108 can be embodied in one or more data processors, such as central processing units (CPUs), application-specific integrated circuits (ASICs), microprocessors, or other devices or components capable of performing the functions associated with the audio processor 108.

The audio buffer 116 can include memory capable of storing incoming audio data. The audio buffer 116 can be stored on volatile or non-volatile memory. The audio buffer 116 can store a predetermined amount of audio data, such as a predetermined size (e.g., in bytes) or a predetermined length (e.g., in seconds) of audio data. In some cases, the audio buffer 116 can store the last n seconds of incoming audio data. The audio buffer 116 can overwrite itself in real time so that the last n seconds or last n bytes of audio data are always available. In an example, the audio buffer 116 can store approximately five seconds worth of audio data, although shorter or longer audio buffers 116 can be used. In some cases, the size or length of the audio buffer 116 can be manually set, such as by a setting of a program or application utilizing the audio buffer 116. In some cases, the size or length of the audio buffer 116 can be automatically set, such as automatically increasing the size of the audio buffer 116 if a determination is made that current size of the audio buffer 116 is insufficient for its current purposes, or automatically decreasing the size of the audio buffer 116 if a determination is made that the current size of the audio buffer 116 exceeds is current purposes. In some cases, the size of the audio buffer 116 can be automatically scaled based on certain settings or parameters, such as a recording mode (e.g., more or less sensitive), input choice (e.g., line input versus microphone input), environmental parameters (e.g., noisy environment versus a quiet environment or steady noise environment versus an environment with occasional disruptive noises).

The automatic start/stop engine 110 can include one or more of an automatic start detector and an automatic stop detector. The automatic start/stop engine 110 can process incoming audio data (e.g., from an audio input 104, from a data store 106, or from the audio buffer 116). In some cases, the automatic start/stop engine 110 can dynamically analyze the contents of the audio buffer 116 to determine if a start event has occurred. In some cases, the automatic start/stop engine 110 can dynamically analyze and compare the first half of the audio buffer 116 with the second half of the audio buffer 116 to determine if a start event has occurred in the middle of the audio buffer 116.

The automatic start/stop engine 110 can look for characteristics (e.g., mathematical, calculated, musical, or other characteristics) of the audio data that are indicative of a start event. The start event can correspond to a time at which a desired action is to take place. For example, upon detecting a start event, the automatic start/stop engine 110 can initiate recording of the incoming audio data, such as by copying some or all of the audio buffer 116 (e.g., that portion of the audio buffer 116 that occurs at or after the start event) into an audio file 124 of a data store 118 and begin appending audio file 124 with real time audio data using the audio recording engine 112. Upon detecting a start event, the automatic start/stop engine 110 can also initiate analysis of the incoming audio data using the audio analyzing engine. The automatic start/stop engine 110 can trigger other tasks upon detection of a start event.

In some cases, the automatic start/stop engine 110 can look for a pre-determined start event, such as the presence of musical content in the audio data. In some cases, the automatic start/stop engine 110 can look for other start events, such as detection of a count-off (e.g., speech recognition of "one, two, three, four") or detection of a particular characteristics such as a note, chord, or sequence of notes or chords (e.g., if a user wishes to record a second take of an existing recording, the automatic start/stop engine 110 can detect when the incoming audio data has characteristics similar to the beginning characteristics of the existing recording). In some cases, the automatic start/stop engine 110 can be used to trigger an action upon detection of musical content, versus noise or non-musical speech.

The automatic start/stop engine 110 can also analyze incoming audio data to determine a stop event (e.g., similarly to how a start event is determined). The stop event can be similar to and opposite from the start event, or can be otherwise defined. Upon detection of the stop event, the automatic start/stop engine 110 can trigger an action to stop (e.g., recording of incoming audio data) or trigger another action to be performed (e.g., transmitting the audio file 124 or beginning of post-processing the audio file 124). In an example use case, an automatic start/stop engine 110 can be used to automatically remove non-musical content from a radio station being recorded; the automatic start/stop engine 110 can automatically start recording (e.g., to create a new audio file 124 or append an existing audio file 124) upon detection of musical content and can automatically stop or pause recording upon detection of non-musical content.

According to embodiments of the present invention, audio file 124 may include music performance data, which may be data that represents the detected musical performance containing musical content. The music performance data may be further processed by an automatic composer to allow a user to automatically compose a new song by rearranging segments of the music performance data into a new musical composition.

The audio recording engine 112 can store incoming audio data as an audio file 124 stored on a data store 118. The data store 118 can be the same data store as data store 106, or can be a different data store 118. Data store 118 can be any suitable storage medium accessible to the audio processor 108, such as internal memory, external memory, or remote memory. In some cases, audio recording engine 112 can access audio buffer 116 to prepend any incoming audio data with some or all of the audio data stored in the audio buffer 116. In some cases, the audio recording engine 112 can append an existing audio file 124, such as if an audio file 124 was created using some or all of the audio data stored in the audio buffer 116.

The audio analyzing engine 114 can process incoming audio data (e.g., from live audio signals 120 or existing audio files 122) to generate metadata 126 related to audio data 124. The metadata 126 can correspond to musical properties of the audio data, such as a melody transcription, a chord transcription, one or more key signatures, or other such musical properties of the audio data. The metadata 126 can be stored as an independent file on the data store 118 and be related to the audio file 124. In some cases, the metadata 126 and the audio file 124 can be stored as parts in the same data file. In some cases, metadata 126 can be encoded directly into the audio file 124 (e.g., as signals that are demodulatable from the audio signal in the audio file 124).

The audio analyzing engine 114 can perform one or more of real time (e.g., approximately real time or dynamic) and non-real time (e.g., post-processing of an entire audio file 124) analysis of audio data. In some cases, the audio analyzing engine 114 can perform an initial real time analysis of incoming audio data (e.g., as being played from a live instrument 102) to determine some musical properties or estimates of musical properties, and then perform an additional non-real time analysis of the audio file 124 to determine some musical properties or validate estimated musical properties.

In some cases, an audio analyzing engine of another device (e.g., a remote server) can perform additional processing to determine or validate one or more musical properties of the audio data (e.g., of audio file 124). In some cases, the audio processor 108 can transmit the audio file 124, the metadata 126, or both to the other device for further processing. For example, the further composing may include automatically composing a song utilizing an automatic composer, according to embodiments of the present invention. Upon processing the received data, the other device can transmit new or updated data to the audio processor 108 (e.g., a new audio file 124, new metadata 126, or both). Continuing along the aforementioned example, the new or updated data may be a musical composition containing musical segments that are rearranged from music performance data as contained in audio file 124.

In some cases, the audio processor 108 can be coupled to an output device, such as a display 130 or an audio output 132, although other output devices can be used. The audio processor 108 can produce outputs through the output device(s) related to any processes occurring in the audio processor 108, such as an audio analyzing process. In an example, the audio analyzing engine 114 can output musical properties to a display 130 (e.g., computer monitor or smartphone screen) in real time while the audio data is being received by the audio processor 108. In another example, the audio analyzing engine 114 can use the detected musical properties to generate an accompaniment (e.g., a bass line generated based on detected chord progressions) which can be played through an audio output 132 (e.g., a speaker or line out).

As described herein, the audio processor 108 can output data (e.g., audio files 124 and metadata 126) to a data store 118. In some cases, outputting data can involve transmitting (e.g., streaming over a network connection) the data to a another device. For example, an audio processor 108 of a smartphone can receive an audio signal 120 from a live instrument 102, record incoming audio data as an audio file 124, analyze the audio data using the audio analyzing engine 114 to generate metadata 126, and transmit the audio file 124 and metadata 126 (e.g., through real time streaming) to a computer located remote from the smartphone.

A. Recording Environment

Figure 2:
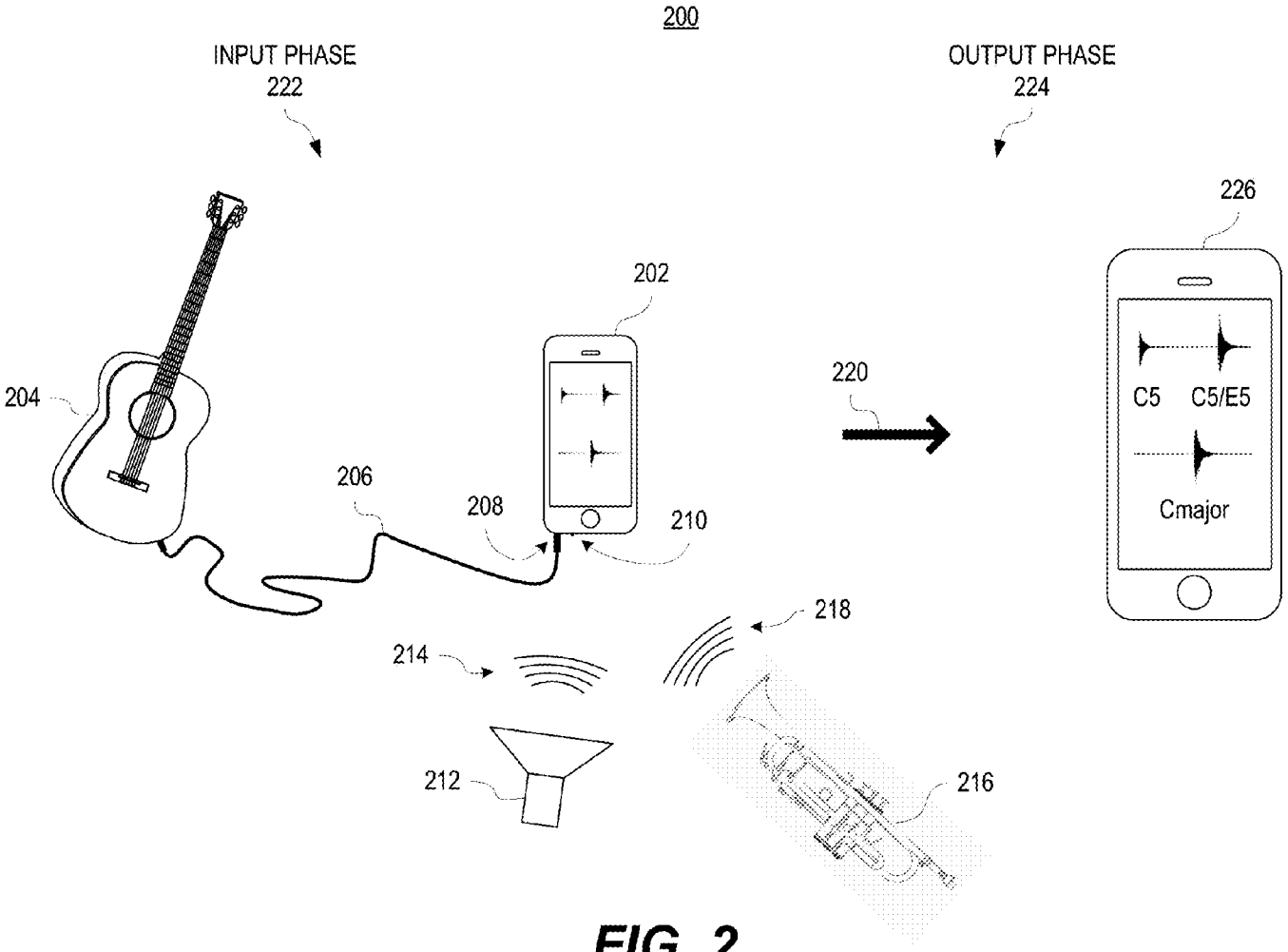
FIG. 2 is a schematic diagram illustrating a recording environment, according to embodiments of the present invention.

FIG. 2 is a schematic diagram depicting a recording environment 200 according to certain aspects of the present disclosure. An input phase 222 and an output phase 224 are shown. During the input phase 222, the an audio processing device 202 can receive audio data from one or more sources. During the output phase 224, the audio processing device 226, which can be audio processing device 202 at a later point in time or another audio processing device, can process or display metadata 228 related to the audio data received during the input phase 222. An audio processing device 202, 226 can be any suitable device for receiving and processing audio data, such as a smartphone having a line input 208 (e.g., ⅛" headset jack) and a microphone 210. An audio processing device 202, 226 can be the audio processing system 100 of FIG. 1. The elements of FIG. 2 are not necessarily shown to scale.

The audio processing device 202 can receive audio data through a cable 206 coupled to the line input 208. The line input 208 can receive line level, microphone level, or other level input. Any suitable instrument or audio device can be coupled to the cable 206, such as an guitar 204 having an electric pickup. Examples of other suitable audio devices include electric pianos, microphone preamplifiers, a media player (e.g., MP3 player or compact disc player), a media receiver (e.g., radio receiver or internet streaming audio receiver), or other device capable of generating an audio signal. In some cases, the line input 208 can be coupled to multiple instruments or audio devices through the use of splitters, mixers, or other such audio equipment.

The audio processing device 202 can receive audio data through a microphone 210. The audio data can be sound waves 218 from an instrument 216 or sound waves 214 from another audio source. An instrument 216 can be any traditional or non-traditional instrument capable of generating acoustic sound waves detectable by microphone 210. Examples of other audio sources include a speaker 212 (e.g., home stereo speakers or loudspeakers at a public venue), nature-based sounds (e.g., wind noises or water noises), or any other source of sound waves 214.

The audio processing device 202 can receive audio data from one or more audio sources at a time. For example, the audio processing device 202 can receive audio data from multiple instruments 216 through the microphone 210, multiple instruments 214 through the line input 208, or multiple instruments 204, 216 through the line input 208 and microphone 210, respectively.

The audio processing device 202 can perform operations on the incoming audio data, such as those described herein and with reference to audio processor 108 of FIG. 1. The operations may result in generation of metadata that may be used for post-processing.

B. Post-Processing of Metadata

Figure 3:
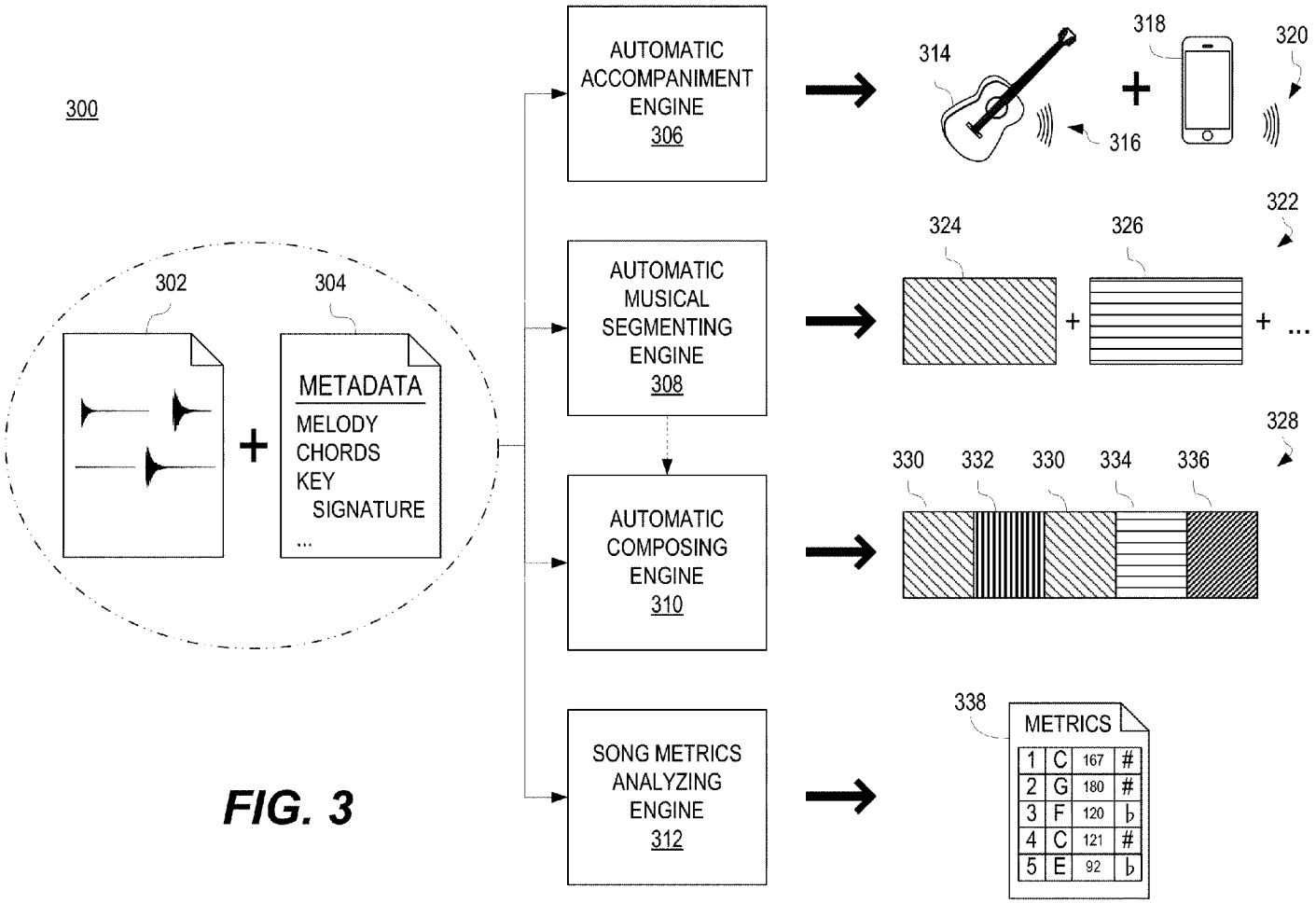
FIG. 3 is a schematic diagram illustrating a metadata usage environment, according to embodiments of the present invention.

FIG. 3 is a schematic representation of a metadata usage environment 300 according to certain aspects of the present disclosure. Metadata usage environment 300 can be any environment for making use of metadata 304 associated with audio data 302. Metadata 304 and audio data 302 can be stored (e.g., in a file on a data store, such as data store 118 of FIG. 1) or can be provided in real time (e.g., approximately real time) from an audio analyzing engine (e.g., audio analyzing engine 114 of FIG. 1). In embodiments, metadata usage environment 300 may post-process metadata to perform useful functions, such as functioning as an automatic accompaniment engine, a segmenting engine, an automatic composing engine, and a song metrics analyzing engine, as will be discussed herein.

The metadata usage environment 300 can operate on a suitable device, such as an audio processor (e.g., audio processor 108 of FIG. 1), an audio processing device (e.g., audio processing device 202, 226 of FIG. 2), or any other device suitable for making use of the metadata 304, such as a computer or smartphone. Several examples for using the metadata 304 are described with reference to the metadata usage environment 300, however the metadata 304 can be used in additional ways as well.

The metadata usage environment 300 can include an automatic accompaniment engine 306. The automatic accompaniment engine can use received metadata 304, and optionally received audio data 302, to generate an accompaniment. The accompaniment can be a collection of musical notes, chords, drum beats, or other musical sounds determined to musically fit with the audio data 302. The automatic accompaniment engine 306 can use musical properties identified in the metadata 304 associated with the audio data 302 to determine an accompaniment that satisfies a harmonic or musical fit with the audio data 302.

For example, audio data 302 may include a melody 316 played by a guitar 314. The metadata 304 may include a melody transcription for the melody 316 played by the guitar 314, as well as an identified key signature for the audio data 302. The automatic accompaniment engine 306 can use the key signature and melody transcription from the metadata 304 to identify other notes to play that would fill possible chords at various points in the piece (e.g., at the downbeat of every two measures). A device 318 (e.g., a smartphone or computer) implementing the automatic accompaniment engine 306 can play an accompaniment 320 based on the notes identified to fill possible chords. In some cases, the accompaniment 320 can be saved as another audio file or added to the audio data 302. In other cases, the accompaniment 320 can be performed by the device 318 (e.g., through a speaker, a line output, or a MIDI output to a MIDI instrument) as the audio data 302 is being played. In some cases, where the audio data 302 and metadata 304 are being provided in real time, the device 318 may generate an accompaniment 320 to play along with a live performer.

The automatic accompaniment engine 306 can use any metadata 304 to generate the accompaniment. In some cases, certain metadata 304 can have a stronger weighting than other metadata (e.g., an identified key can have a stronger weight towards identifying what notes to play in an accompaniment than a melody transcription). The automatic accompaniment engine 306 can assign a confidence score for each attribute of the accompaniment (e.g., when to play a sound, for what duration to play the sound, what notes or chords to include in the sound, and the like) based on how well that attribute fits with the metadata 304.

Metadata usage environment 300 can include an automatic musical segmenting engine 308. The automatic musical segmenting engine 308 can use metadata 304 to split audio data 302 into a collection 322 of musical segments 324, 326. Any number of musical segments can be included in a collection 322. The automatic musical segmenting engine 308 can segment the audio data 302 based on musical attributes, such as chords, tempos, key signatures, measures, meters, musical figures, musical motifs, musical phrases, musical periods, musical sections, and other such attributes that are discernable from the audio data 302, metadata 304, or both.

In an example, audio data 302 for a song may have associated metadata 304 that includes rhythmic data and melody transcriptions. The automatic musical segmenting engine 308 can identify any combination of rhythmic patterns and melody patterns and segment the audio data 302 where the patterns repeat to create audio segments 324, 326. In another example, the automatic musical segmenting engine 308 can simply use rhythmic data (e.g., from metadata 304) to determine the downbeat of measures and segment the audio data 302 according to a manually set number of measures.

The metadata usage environment 300 can include an automatic composing engine 310.

Automatic composing engine 310 may include lines of code and/or hardware and accompanying firmware configured to operate as an automatic composer, according to embodiments of the present invention. The automatic composing engine 310 can create a song 328 by piecing together any number of individual audio segments 330, 332, 334, 336. The song 328 can include only unique audio segments 330, 332, 334, 336 (e.g., no audio segment repeats), or can include one or more repeating audio segments (e.g., audio segment 330 in the example shown in FIG. 3). Each audio segment 330, 332, 334, 336 can be a segment 324, 326 (e.g., from the automatic musical segmenting engine 308). In some cases, each audio segment 330, 332, 334, 336 is a distinct audio file that has not been processed by an automatic musical segmenting engine 308.

The automatic composing engine 310 can use metadata 304 associated with the segments 330, 332, 334, 336 to determine a desirable order in which to arrange the audio segments 330, 332, 334, 336. The automatic composing engine 310 can determine a correlation score between the beginning and ending of each audio segment 330, 332, 334, 336 and arrange the audio segments 330, 332, 334, 336 based on the correlation scores. The correlation scores can take into account musical properties, such as key, melodic transcription, chord transcription, rhythmic data, tempo, and other such properties. Other evaluation methods can be used to determine a musical affinity between adjacent segments.

In some cases, the automatic composing engine 310 can specifically select an order of audio segments 330, 332, 334, 336 that is designed to produce an interesting song 328 (e.g., having varied musical properties between adjacent segments). For example, an automatic composing engine 310 may create a song 328 that includes a segment 330 identified as having a first chord progression, followed by a segment 332 identified as having a second chord progression in the same key as segment 330, followed by segment 330 again, followed by a segment 334 identified as having only melody transcription and no chord transcriptions, followed by a segment 336 identified as having a resolution (e.g., a held consonance note after a dissonant chord).

In some cases, one or more segments can be identified as an intro or outro segment, in which case the automatic composing engine 310 can use those segments exclusively at the beginning or end of the song 328, respectively. Intro and outro segments can be identified manually or automatically. Automatically identified intro and outro segments can be identified based on presence in an original piece (e.g., the first and last segments corresponding to the beginning and end of an audio file processed by an automatic musical segmenting engine 308 may be automatically labeled as intro and outro, respectively). Automatically identified intro and outro segments can also be identified based on musical properties of the segment itself.

In some cases, the automatic composing engine 310 can select a subset of audio segments from a larger set of audio segments for use in a song 328. For example, an automatic composing engine 310 may have access to a set of 80 audio segments (e.g., from multiple collections 322 of audio segments created using an automatic musical segmenting engine 308 on a plurality of audio files). The automatic composing engine 310 may select which out of the set of 80 audio segments to use in the final song 328. This selection process can be based on any combination of manual settings (e.g., a user desiring a two minute song) and musical properties (e.g., selecting all segments that match a particular key signature).

In some cases, the automatic composing engine 310 can allow a user to manipulate the order of the segments. The automatic composing engine 310 can store historical information related to the past manual placement of audio segments in relation to other audio segments and in relation to an overall song 328. The automatic composing engine 310 can learn from this historical information and use the historical information to improve its audio segment ordering and selection processes. In some cases, the historical information can be used to adjust the weighting of certain musical properties and can recognize patterns in audio segment placement.

Although FIG. 3 illustrates automatic musical segmenting engine 308 as a separate engine from automatic composing engine 310, embodiments are not so limited. For instance, automatic segmenting engine 308 may be a part of automatic composing engine 310. Accordingly, automatic segmenting engine 308 may be a subfunction of automatic composing engine 310, as will be discussed in more detail herein.

The metadata usage environment 300 can include a song metrics analyzing engine 312. The song metrics analyzing engine 312 can analyze any attributes of the metadata 304 associated with audio data 302. The song metrics analyzing engine 312 can be used to determine patterns, relationships, averages, or other metrics associated with musical properties of the audio data 302. For example, the song metrics analyzing engine 312 can determine the most common chord used in a piece, the number of times each note was used in a piece, the average tempo or tempo changes throughout a piece, and other metrics. The song metrics analyzing engine 312 can provide metrics data 338 to other engines or devices for further use. Metrics data 338 from multiple songs can be compared and further analyzed, such as to determine correlations between multiple songs.

In an example, a song metrics analyzing engine 312 can be used on a set of songs to generate metrics data 338 regarding the key signatures, chords, notes, tempos, and other musical properties of each song in the set. Comparison of the metrics data 338 can be used to order the songs (e.g., for a playlist or an album) in a meaningful way. For example, metrics data 338 can be used to order similar songs adjacent one another. In another example, metrics data 338 can be used to order songs so that similar songs (e.g., with similar chord or note distributions, similar tempos, similar keys, or other similar characteristics) are not directly adjacent one another (e.g., to improve variety in a playlist or album).

The ability to obtain audio data 302 and associated metadata 304, as well as to use the audio data 302, metadata 304, or both brings substantial benefit to music enthusiasts, including performers, technicians, and listeners alike. For example, the use of an audio processor 108 having an automatic start/stop engine 110 as described in FIG. 1 can simplify the recording process for a musician. As another example, the ability to analyze incoming audio data to generate metadata (e.g., metadata 126 generated by the audio analyzing engine 114 of FIG. 1) can enable many different uses of the recordings or live performances (e.g., as seen in FIG. 3). Furthermore, the aspects described herein will enable musicians to record, analyze, and manipulate their music in new and unique ways.

It can be appreciated that may functions can be performed from utilizing metadata of audio files. These functions may be complex functions that require several processing steps, as will be discussed herein for an automatic composer.

II. Automatic Composer

Figure 4:
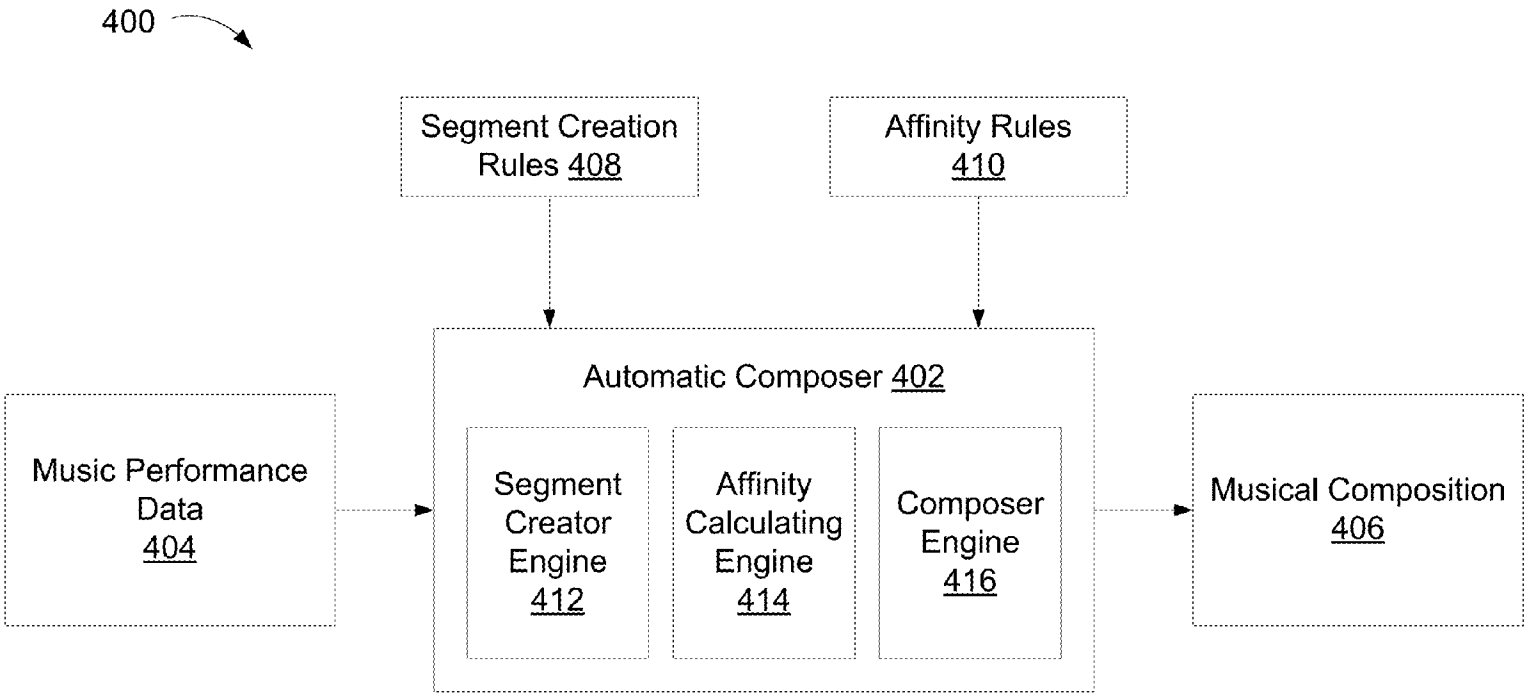
FIG. 4 is a block diagram illustrating a system incorporating an automatic composer, according to embodiments of the present invention.

FIG. 4 is a simplified block diagram 400 for an automatic composer 402, according to embodiments of the present invention. Automatic composer 402 may be program code stored on a memory device (e.g., another server) configured to be executed by a processor to perform a function, such as generating a musical composition as will be discussed herein. Alternatively, automatic composer 402 may be a combination of hardware and software specially configured to perform the function. For example, automatic composer 402 may be a data processing system containing software configured to perform the function.

In embodiments, automatic composer 402 may receive an input and generate a meaningful output. For example, music performance data 404 may be received by automatic composer 402. In embodiments, music performance data 404 may include audio data 302 and associated metadata 304 as discussed in FIG. 3. For instance, music performance data 404 may be a single digital recording or a collection of digital recordings and their corresponding data related to melody, harmony, and rhythm. Automatic composer 402 may use music performance data 404 (which includes corresponding music analysis data as will be discussed further herein) to generate a musical composition 406. In embodiments, automatic composer 402 may generate musical composition 406 by initially segmenting music performance data 404 into one or more musical segments. The musical segments may then be arranged into a cohesive piece of musical work, thereby resulting in the generation of musical composition 406.

In some embodiments, automatic composer 402 may generate musical composition 406 from music performance data 404 based upon sets of rules. For instance, automatic composer 402 may generate musical composition 406 based upon two sets of rules: segment creation rules 408 and affinity rules 410. Segment creation rules 408 may be a list of structural attributes of musical pieces that are desired to be present in each musical segment. For instance, segment creation rules 408 may be a list that includes a number of beats and bars regardless of tempo, chord sequences, rhythmic structure, and the like. Affinity rules 410 may be a list of musical attributes of musical pieces that are desired to be shared amongst each musical segment in musical composition 406. As an example, affinity rules 410 may be a list that includes chord progression, beats, rhythm, and the like. The details and purposes of segment creation rules 408 and affinity rules 410 will be discussed further herein.

In embodiments, automatic composer 402 may include functional engines that are each configured to perform a different function for generating musical composition 406. For instance, automatic composer 402 may include a segment creator engine 412, affinity calculating engine 414, and composer engine 416. Each engine 412, 414, and 416 may be lines of program code stored on a memory device configured to be executed by a processor. In some embodiments, engines 412, 414, and 416 may include hardware and firmware. The interaction between the three engines may enable automatic composer 402 to generate musical composition 406 from music performance data 404 based upon segment creation rules 408 and affinity rules 410. Details of these engines are discussed further herein.

III. Segment Creator Engine

As mentioned herein, automatic composer 402 may segment music performance data 404 into a plurality of musical segments. To perform this function, automatic composer 402 may include segment creator engine 412 as shown in FIG. 5.

Figure 5:
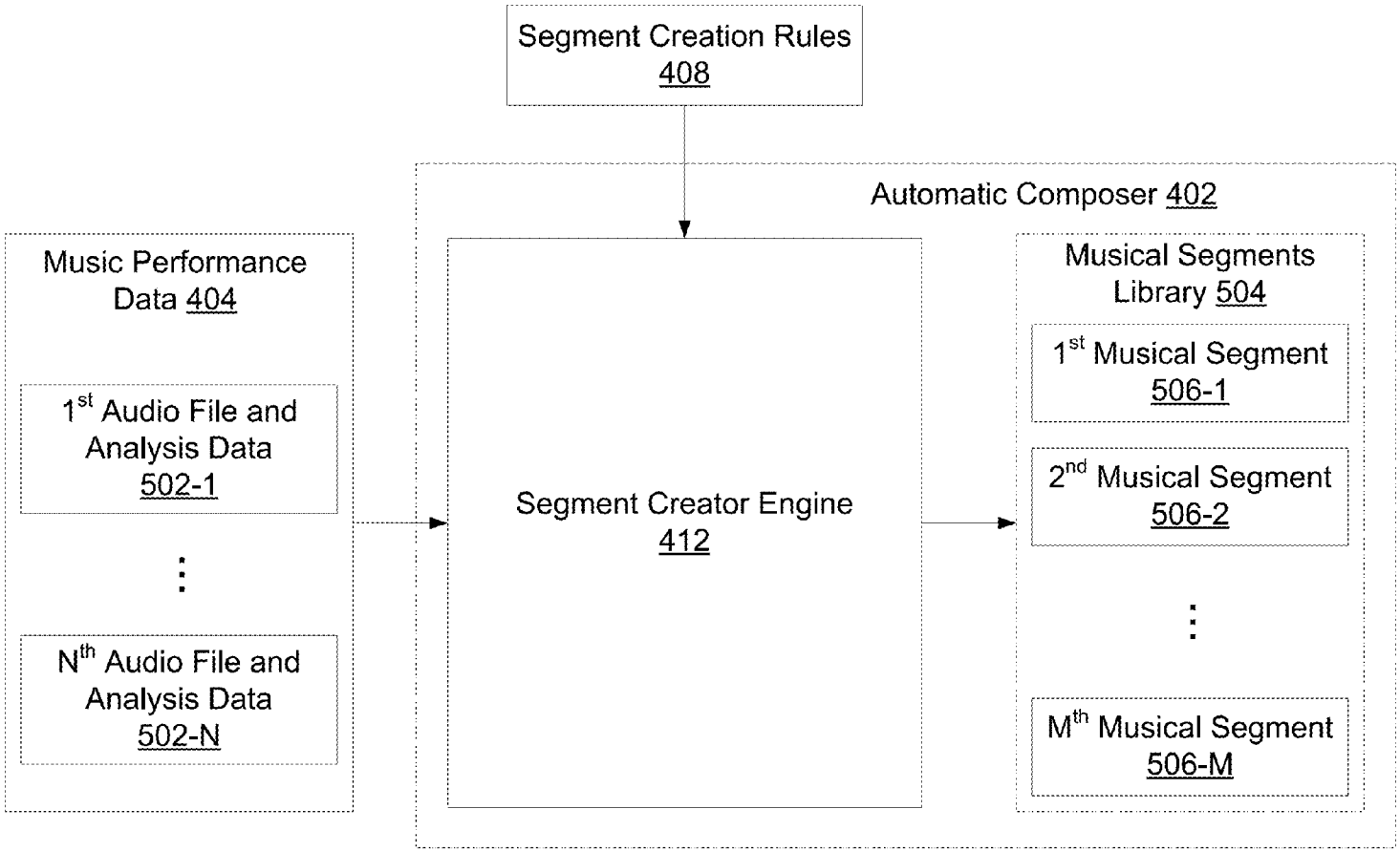
FIG. 5 is a block diagram illustrating a segment creator engine for an automatic composer, according to embodiments of the present invention.

FIG. 5 is a block diagram illustrating the operation of a segment creator engine, such as segment creator engine 412, according to embodiments of the present invention. Segment creator engine 412 may be a subfunction of automatic composer 402 that is configured to perform a small part of a greater function. For instance, segment creator engine 412 may be configured to segment music performance data into one or more musical segments such that automatic composer 402 may use the musical segments to generate a musical composition.

In some embodiments, segment creator engine 412 receives music performance data 404. Music performance data 404 may be generated by a preprocessing engine (not shown). The preprocessing engine may be any suitable body of computer code that can analyze audio files to extract data, such as data pertaining to melody, harmony, and rhythm from an audio file. As an example, the preprocessing engine may be audio processor 108 discussed in FIG. 1. The analysis of each audio file may be appended to the audio file as metadata, which may be utilized by subsequent processing. In embodiments, music performance data 404 may include one or more audio files and analyses data pertaining to melody, harmony, and rhythm. For instance, music performance data 404 may include one or more audio files, i.e., audio data 302, and associated analysis data, i.e., metadata 304, discussed in FIG. 3. It is to be appreciated that any number of audio files and analysis data may be included as music performance data 404. For instance, a single audio file and analysis data may be included as music performance data 404. Alternatively, a number N of audio files and analysis data ranging from 1 to N may be included as music performance data 404. That is, music performance data 404 may include $1^{st}$ audio file and analysis data 502-1 through $N^{th}$ audio file and analysis data 502-N.

Segment creator engine 412 may receive music performance data 404 and subsequently segment music performance data 404 into one or more musical segments. As shown in FIG. 5, segment creator engine 412 may segment musical performance data 404 into a plurality of musical segments 506. For example, segment creator engine 412 may segment musical performance data 404 into a number M of musical segments 506, i.e., $1^{st}$ musical segment 506-1 to $M^{th}$ musical segment 506-M. Musical segments 506 may be stored in a musical segments library 504, which may be an allocation of memory in a memory bank configured to store musical segments 506-1 through 506-M. Alternatively, musical segments library 504 may consist of a list of addresses linking to specific locations in memory where data for musical segments 506-1 through 506-M are located.

In certain embodiments, music performance data 404 may be segmented based upon segment creation rules 408. Segment creation rules 408 may determine how audio files and analysis data 502 in music performance data 404 will be segmented by segment creator engine 412. Segment creation rules 408 may be a list of structural attributes of musical pieces that are desired to be present in each musical segment. Structural attributes may be related to an underlying musical framework of a musical piece. The musical framework of a musical piece may include properties of a musical segment that are unrelated to how a musical segment sounds, such as, but not limited to, number of beats and bars regardless of tempo, chord sequences, rhythmic structure, spectral similarity over time, baseline similarity, role of the musical segment in the original music performance data (e.g., whether the musical segment is an intro, chorus, bridge, and the like), presence of vocal content, specific instruments detection (e.g., whether the musical segment is a guitar or a piano piece), and the like. As an example, if segment creation rules 408 contain a structural attribute specifying four musical bars, segment creator engine 412 may segment each audio file 502 into a plurality of musical segments 506 where each musical segment 506-1 through 506-M contains only four musical bars.

It is to be appreciated that musical segments library 504 may include musical segments 506-1 through 506-M that have been stored at different periods of time. For instance, $1^{st}$ musical segment 506-1 may have been stored several days or months prior to the time at which 2nd musical segment 506-2 was stored. Furthermore, musical segments 506-1 through 506-M may be segments of different audio files 502-1 through 502-N. As an example, $1^{st}$ musical segment 506-1 may be a segment of $1^{st}$ audio file 502-1 and $2^{nd}$ musical segment 506-2 may be a segment of $2^{nd}$ audio file (not shown). On the other hand, musical segments 506-1 through 506-M may be segments of the same audio file. For instance, $3^{rd}$ musical segment (not shown) and $4^{th}$ musical segment (not shown) may be segments of $2^{nd}$ audio file (not shown).

Additionally, it is to be appreciated that each musical segment 506-1 through 506-M may still contain analysis data, e.g., metadata, from the preprocessing engine (not shown). Thus, although musical segments 506 are each a portion of audio files 502, each musical segment 506-1 through 506-M may include data pertaining to its melody, harmony, and rhythm. This analysis information may be utilized to determine a degree of similarity between musical segments, as will be discussed further herein.

A. Musical Segment

Each musical segment created by segment creator engine 412 may include distinct parts. In certain embodiments, each musical segment may include a prologue, an epilogue, and/or a verse.

A prologue may be a portion of an audio file that is devoid of musical data. For instance, a prologue may not have melody, harmony, or rhythm. Additionally, a prologue may be a portion of an audio file that immediately precedes a portion of an audio file that has melody, harmony, or rhythm. As an example, a prologue may be a portion of an audio file where a musician takes a breath before playing an instrument. Thus, the prologue may represent a beginning of a musical piece.

Similar to a prologue, an epilogue may also be a portion of an audio file that is devoid of musical data. However, in contrast to a prologue, an epilogue may be a portion of an audio file that immediately follows a portion of an audio file that has melody, harmony, or rhythm. For instance, an epilogue may be a portion of an audio that includes audio of a person talking or audio containing non-harmonic background noise. It may represent an ending of a musical piece.

In contrast to both a prologue and an epilogue, a verse is a portion of an audio file that has musical data. As an example, a verse may be a portion of an audio file that has melody, harmony, and/or rhythm. In embodiments, a verse may be a riff, a chorus, a solo piece, and the like.

Figures 6A, 6B, 6C, 6D:
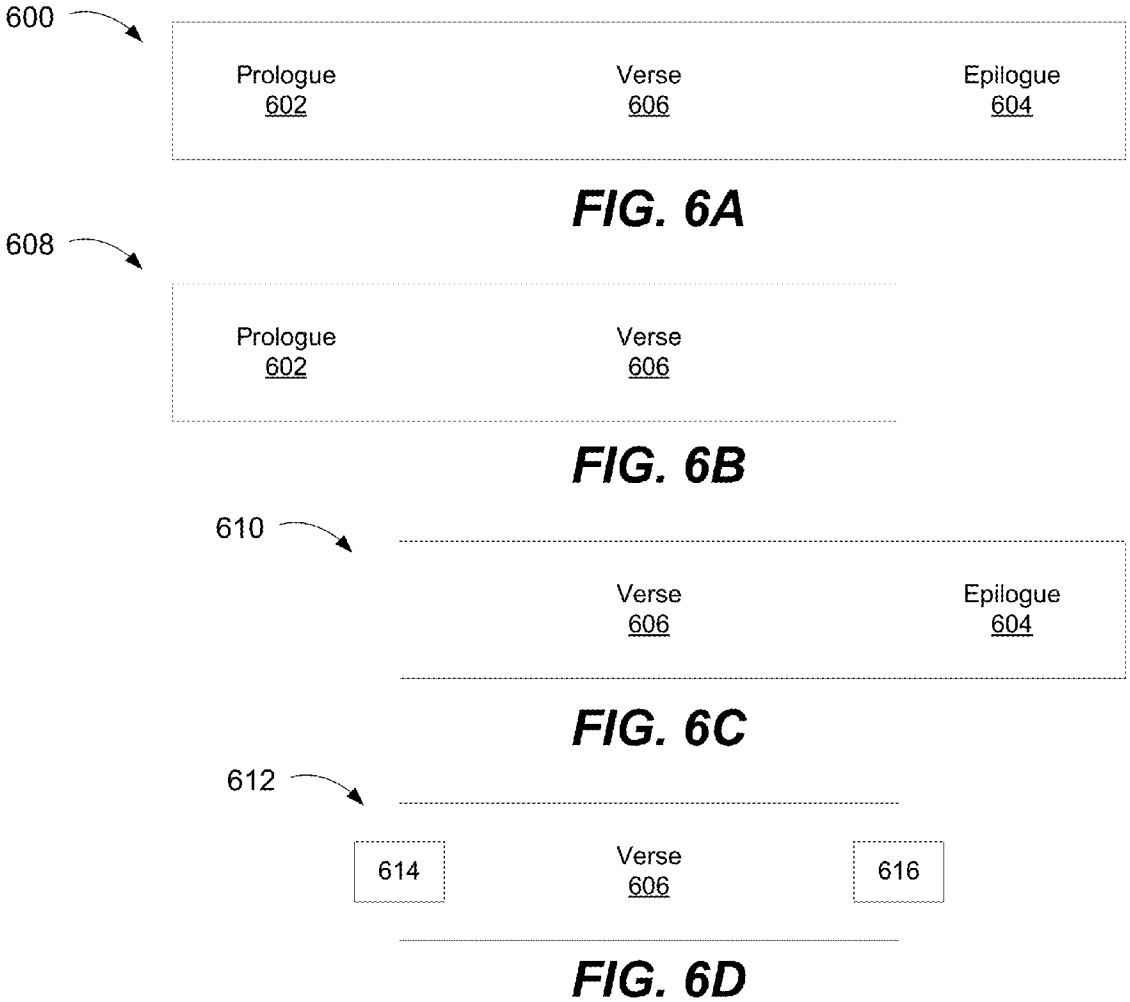
FIGS. 6A-6D are simplified diagrams illustrating how segments may be structured, according to embodiments of the present invention.

Each musical segment may contain one or a combination of a prologue, an epilogue, and a verse. FIGS. 6A-6D illustrate different types of musical segments that can be created by segment creator engine 412. As shown in FIG. 6A, an exemplary musical segment 600 may include all three parts: a prologue 602, an epilogue 604, and a verse 606. Prologue 602 immediately precedes verse 606, and epilogue 604 immediately follows verse 606.

It is to be appreciated that musical segments do not have to include all three parts. FIG. 6B illustrates an exemplary musical segment 608 that includes prologue 602 and verse 606 but not epilogue 604. FIG. 6C illustrates an exemplary musical segment 610 having epilogue 604 and verse 606 but no prologue 602. FIG. 6D illustrates an exemplary musical segment 612 having only verse 606 and no prologue 602 or epilogue 604. Although FIGS. 6A-6D do not illustrate a musical segment having only a prologue and/or an epilogue, one skilled in the art understands that musical segments may also be created to have a prologue and/or an epilogue without a verse.

In embodiments, a musical segment may also include transitions 614 and 616 at the beginning and/or end of a verse. FIG. 6D illustrates verse 606 having transitions 614 and 616 at both a beginning and an end of verse 606. Transitions 614 and 616 may be modifications of verse 606 to enhance seamless transition between musical segments. For example, transition 614 may gradually increase an audio level of verse 606 to provide a gradual beginning of verse 606. Transition 616 may gradually decrease an audio level of verse 606 to provide a gradual ending of verse 606

B. Exemplary Segmentation of an Audio File

Figure 7A:
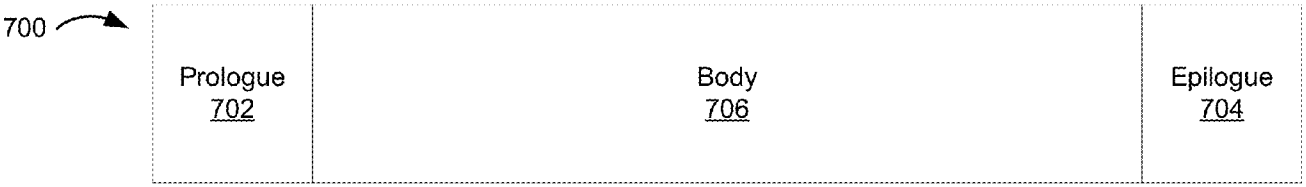
FIGS. 7A-7B are simplified diagrams illustrating segmentation of an audio file, according to embodiments of the present invention.
Figure 7B:
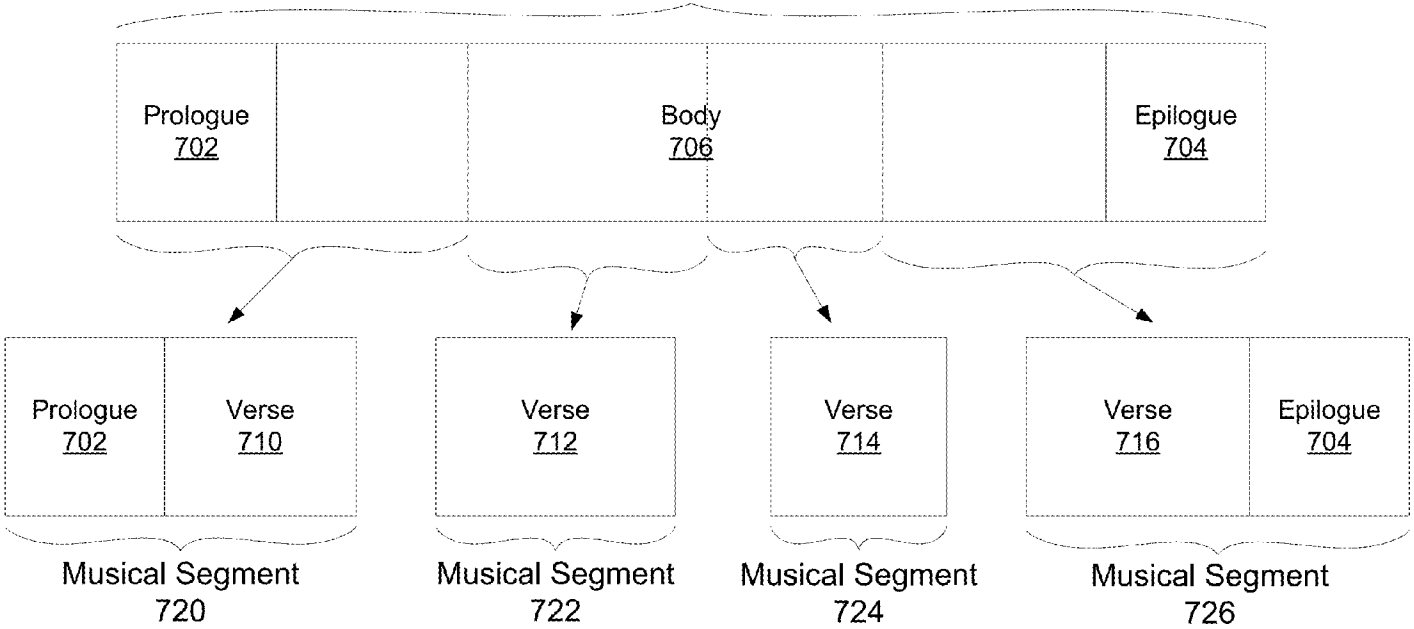

To better describe segmentation of an audio file, FIGS. 7A and 7B illustrate an exemplary segmentation of an audio file into a plurality of musical segments, according to embodiments of the present invention. In FIG. 7A, an audio file 700 is shown as having a prologue 702, an epilogue 704, and a body 706 between prologue 702 and epilogue 704. Audio file 700 may be a musical piece where prologue 702 is an introductory portion that is devoid of musical data (i.e., having no melody, harmony, and rhythm). Following prologue 702 is body 706, which may include musical data such as melody, harmony, and rhythm. In some embodiments, body 706 may include various rifts, choruses, and the like. Following body 706 may be epilogue 704, which is an ending portion that may be devoid of musical data.

In embodiments, audio file 700 may be segmented into a plurality of musical segments as shown in FIG. 7B. For instance, audio file 700 may be segmented into musical segments 720, 722, 724, and 726. Each musical segment may be a part of audio file 700. As an example, musical segment 720 may include prologue 702 and a verse 710. Verse 710 may be a portion of body 706 that includes musical data such as melody, harmony, and rhythm. Other musical segments, such as segments 722, 724, and 726 may contain other parts of audio file 700. For example, musical segment 722 may only include a verse 712, and musical segment 724 may only include a verse 714. Verses 712 and 714 may be parts of body 706 that contain musical data. In embodiments, musical segments 720, 722, 724, and 726 contain similar structural attributes as determined by segment creation rules 708 discussed herein with respect to FIG. 5. For instance, musical segment 720, 722, 724, and 726 may each have four bars, four chords, and the like.

Segmenting audio file 700 into musical segments 720, 722, 724, and 726 allows automatic composer 402 to manipulate the order of musical segments 720, 722, 724, and 726 to generate a musical composition that is different than audio file 700. However, in order for automatic composer 402 to perform such manipulation, automatic composer 402 may determine which musical segments are compatible with one another.

IV. Affinity Calculating Engine

Determining compatibility may be performed by calculating an affinity value. The affinity value may be a numerical value that represents a degree of similarity between two musical segments. In embodiments, the affinity value may be associated with one or more musical attributes shared by the two musical segments. According to embodiments of the present invention, this affinity value may be calculated by an affinity calculating engine, such as affinity calculating engine 414 shown in FIG. 8.

Calculating an affinity value may allow automatic composer 402 to utilize the affinity value to identify musical segments that are similar in musical sound. The identified musical segments may be combined to form a musical composition. Combining musical segments having a degree of similarity provides for a smooth transition between them, thereby resulting in a musical composition that is musically coherent.

Figure 8:
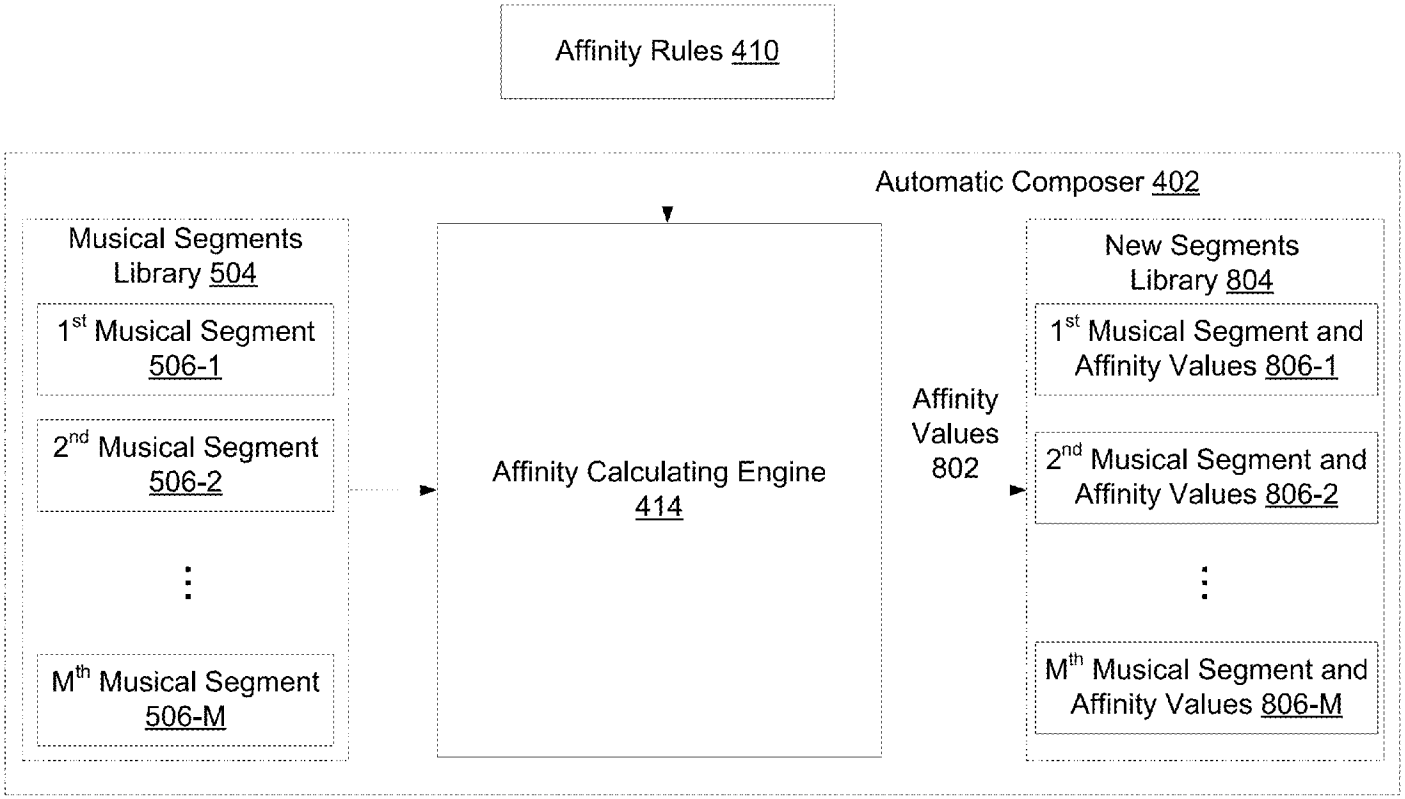
FIG. 8 is a block diagram illustrating an affinity calculating engine for an automatic composer, according to embodiments of the present invention.

FIG. 8 is a block diagram illustrating the operation of affinity calculating engine 414, according to embodiments of the present invention. Affinity calculating engine 414 may be a subset of automatic composer 402 that is configured to perform a small part of a greater function. For instance, affinity calculating engine 414 may be configured to calculate an affinity value for pairings of musical segments such that automatic composer 402 may utilize the affinity value to generate a musical composition, e.g., musical composition 406 in FIG. 4.

In certain embodiments, affinity calculating engine 414 receives a plurality of musical segments from a musical segments library. For instance, affinity calculating engine 414 may receive musical segments 506-1 through 506-M in musical segments library 204 that were created by segment creation engine 412.

Once musical segments 506 are received by affinity calculating engine 414, affinity calculating engine 414 may perform calculations and output affinity values 802. In embodiments, each affinity value 802 may represent a degree of similarity between two musical segments. In certain embodiments, affinity calculating engine 414 may determine an affinity value 802 for each possible pairing of musical segments. In other embodiments, affinity calculating engine 414 may determine more than one affinity value 802 for each possible pairing of musical segments. Such affinity values 802 may then be linked or appended to corresponding musical segments to form a new segments library 804. Accordingly, new segments library 804 may include a plurality of musical segments and affinity values 806, where each musical segment and affinity values 802 includes data pertaining to a musical segment and its corresponding affinity values. In embodiments, new segments library 804 may be an updated version of musical segments library 504 that replaces musical segments library 504.

According to embodiments, affinity values 802 may be calculated based upon a set of affinity rules 410. Affinity rules 410 may include a selection of one or more musical attributes. Musical attributes may include properties of a musical segment that relate to how the musical segment sounds. For instance, musical attributes may include characteristics such as, but not limited to, chord progression, spectral content, beats, rhythm, and harmonic scale. There may be several different types of spectral content. As an example, spectral content may be defined by a spectral distribution of audio data (FFT) localized at the beginning and at the end of verses, at the ending of prologues, or at the beginning of epilogues. Spectral content may also be defined by peaks at each frequency of the overall spectral distribution of a verse. Furthermore, spectral content may be defined by the shape and characteristics (e.g., the width, phase, characteristics, modulation, harmonics distribution) of relevant spectral peaks. It is to be appreciated that musical attributes are different than structural attributes in that musical attributes relate to the arrangement of tones, melodies, chords, harmonies, and the like of a musical piece, while structural attributes are more related to the underlying musical framework of a musical piece. Affinity rules 410 may determine what musical attributes will be shared between musical segments in a musical composition, as will be discussed further herein with respect to FIGS. 10A-10B and 12.

In embodiments, affinity rules 410 determine how affinity values 802 are to be calculated. For example, if affinity rules 410 are selected to include musical attributes such as chord progression and harmonic scale, then affinity values 802 may be a calculated numerical value representing a degree of similarity between two musical segments based upon chord progression and harmonic scale. Affinity values 802 may be a single number that represents a degree of similarity between two musical segments based upon any combination and number of musical attributes. One skilled in the art understands that embodiments are not limited to just two musical attributes.

To provide flexibility and user friendliness, affinity rules 410 may be selected by a user. For instance, a user who desires to arrange segments 506-1 through 506-M according to chord progression and harmonic scale, may select chord progression and harmonic musical attributes to be affinity rules 410. If the user would like to change the established affinity rules 410, the user may deselect certain musical attributes and select new musical attributes. In addition to having a user select musical attributes of affinity rules 410, a default set of musical attributes may be encoded within affinity calculating engine 414 such that a user does not have to select the musical attributes. The selected musical attributes for the default configuration may be determined by a programmer according to a design goal.

A. Affinity Functions

Determining an affinity value between two segments may include calculating an affinity subvalue between two musical segments. The affinity subvalue may be a number that represents a degree of similarity between a shared musical attribute between two musical segments. An affinity subvalue may be distinguished from an affinity value because an affinity subvalue pertains to only one musical attribute shared between two musical segments, while an affinity value pertains to one or more musical attributes shared between two musical segments. Thus, an affinity subvalue may be a more basic determination of a degree of similarity between musical segments, while an affinity value may be a more complex determine of a degree of similarity between musical segments.

Determining an affinity value may further include combining affinity subvalues. The combined affinity subvalues may correspond to the selected musical attributes established by the set of affinity rules. As an example, if the set of affinity rules includes chord progression and harmonic scale, then the affinity subvalues associated with chord progression and harmonic scale may be added together to determine the affinity value. Details of how an affinity value is calculated may be shown in FIG. 9.

Figure 9:
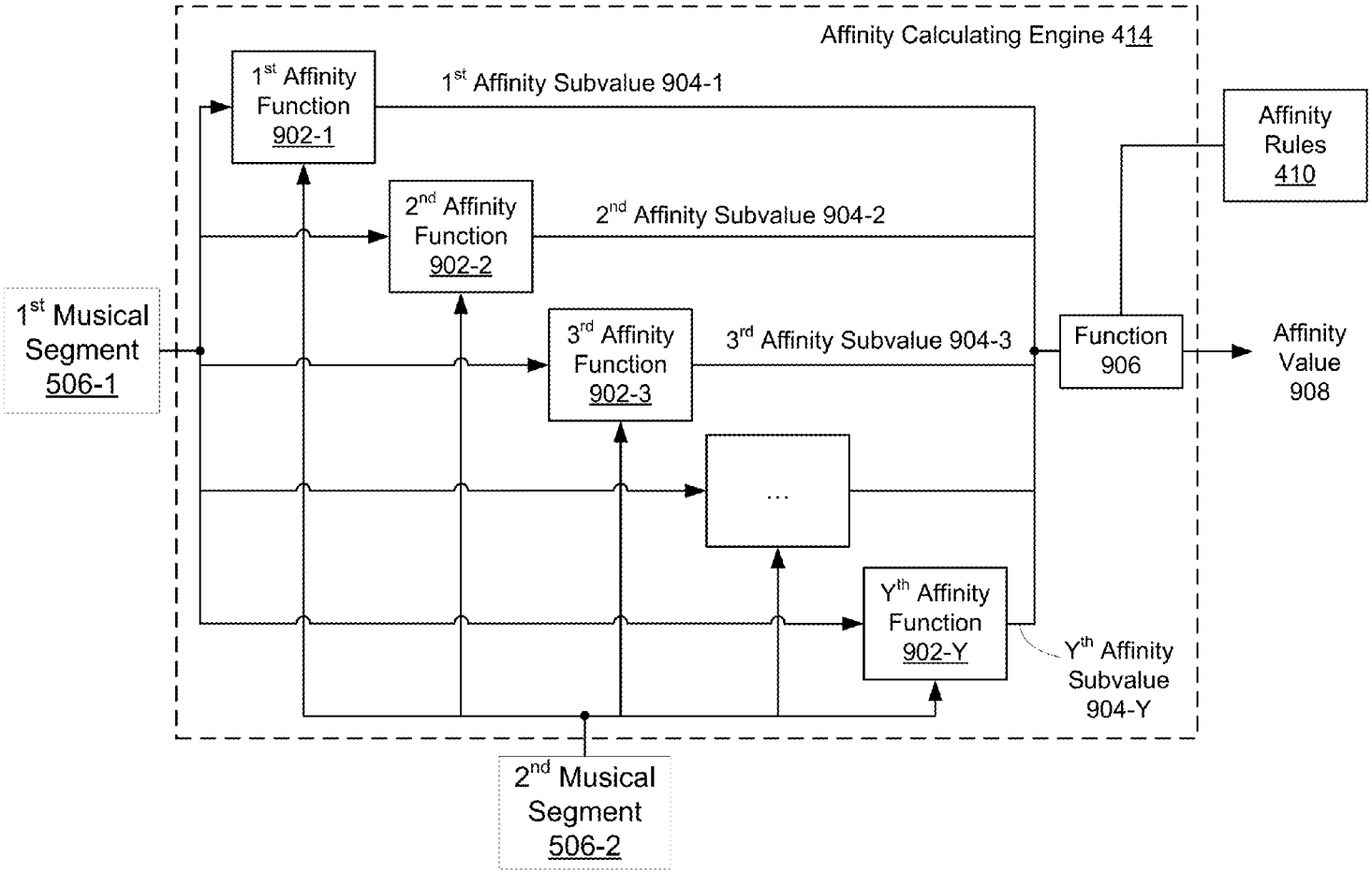
FIG. 9 is a block diagram illustrating affinity functions in an affinity calculating engine, according to embodiments of the present invention.

FIG. 9 is a simplified block diagram illustrating an exemplary affinity calculating engine, such as affinity calculating engine 414, according to embodiments of the present invention. Affinity calculating engine 414 may include a plurality of affinity functions 902. For instance, affinity calculating engine 414 may include a number Y of affinity functions 902 ranging from 902-1 to 902-Y. Each affinity function 902-1 through 902-Y may be a section of program code that is specifically configured to calculate an affinity subvalue 904 based upon a specific musical attribute. In embodiments, an affinity subvalue 904 is determined for every musical attribute, regardless of what is selected in affinity rules 410. As an example, $1^{st}$ affinity function 902-1 may be configured to calculate a degree of similarity based upon chord progression. $2^{nd}$ affinity function 902-2 may be configured to calculate a degree of similarity based upon harmonic scale. It is to be appreciated that any other affinity function may be configured to determine an affinity subvalue for any other musical attribute.

Once affinity subvalues 904 are calculated for every musical attribute, certain affinity subvalues 904 that are associated with the selected musical attributes in affinity rules 410 may be factored together by function 906. Function 906 may receive data from affinity rules 410 pertaining to which musical attributes are selected. Only those musical attribute selected by affinity rules 410 may be multiplied together to determine an affinity value 908. Accordingly, affinity value 908 may be a degree of similarity between $1^{st}$ and $2^{nd}$ musical segments 506-1 and 506-2 based upon the musical attributes selected in affinity rules 410. For instance, affinity value 908 may be a degree of similarity between $1^{st}$ and $2^{nd}$ musical segments 506-1 and 506-2 with regards to chord progression and harmonic scale.

In embodiments, affinity value 908 may be a normalized value. For example, function 906 may not only multiply/combine affinity subvalues together, but function 906 may also normalize the resulting calculation such that the normalized affinity value 908 of a musical segment ranges between 0-1. Any other standardization format may be used to calculate affinity value 908. It is to be appreciated that the following discussion calculates affinity value 908 by merely multiplying together corresponding affinity subvalues for ease of discussion, but is not limited to such calculation methods.

In embodiments, the calculated affinity value 908 may then be linked or appended to corresponding $1^{st}$ and $2^{nd}$ musical segments 506-1 and 506-2 to form $1^{st}$ and $2^{nd}$ musical segment and affinity values 806-1 and 806-2 in new segments library 804, as discussed herein with respect to FIG. 8. Accordingly, $1^{st}$ musical segment and affinity values 806-1 may include affinity value 908, which may represent its similarity to $2^{nd}$ musical segment and affinity values 806-2. Likewise, $2^{nd}$ musical segment and affinity values 806-2 may include affinity value 908, which may represent its similarity to $1^{st}$ musical segment and affinity values 806-1.

Although the discussion herein relates to only $1^{st}$ and $2^{nd}$ musical segments, one skilled in the art understands that similar operations apply to any two musical segments without departing from the spirit and scope of the present invention.

B. Exemplary Calculation of Affinity

Figure 10A:
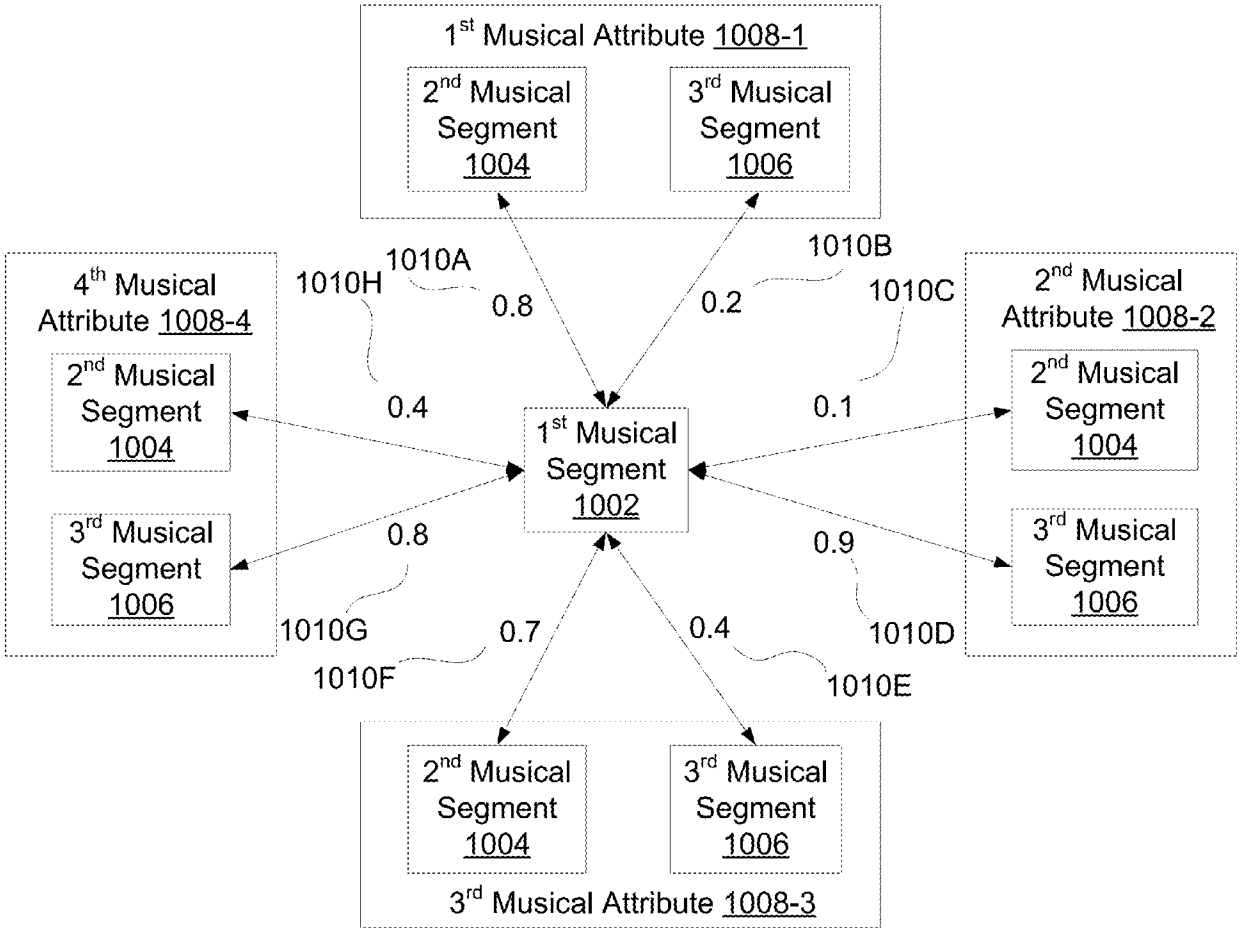
FIG. 10A is a diagram illustrating affinity subvalues for musical segment pairs, according to embodiments of the present invention.
Figure 10B:
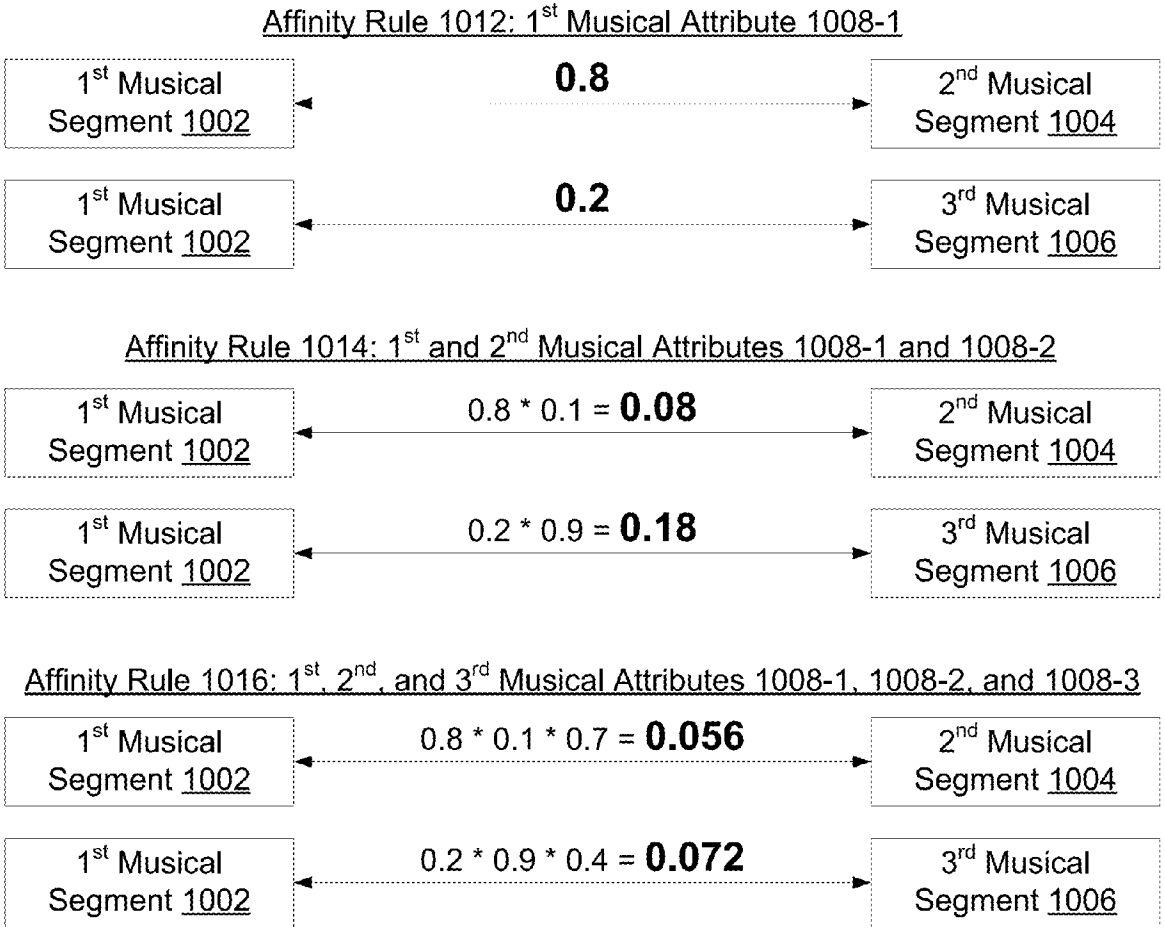
FIG. 10B is a diagram illustrating a calculation of affinity values for musical segment pairs, according to embodiments of the present invention.

FIGS. 10A and 10B are block diagrams for illustrating how the affinity values are calculated, according to embodiments of the present invention. Specifically, FIG. 10A is a block diagram illustrating an exemplary calculation of affinity subvalues for a $1^{st}$ music segment 1002. FIG. 10B is a block diagram illustrating an exemplary calculation of affinity values for the $1^{st}$ music segment 1002. One skilled in the art understands that even though FIGS. 10A and 10B show calculations for only $1^{st}$ musical segment 1002, the same discussion applies to any other musical segment.

As shown in FIG. 10A, $1^{st}$ music segment 1002 is included within a group of three music segments: $1^{st}$ music segment 1002, $2^{nd}$ music segment 1004, and $3^{rd}$ music segment 1006.

Affinity subvalues for each of the three music segments are calculated for four different musical attributes: $1^{st}$ musical attribute 1008-1, $2^{nd}$ musical attribute 1008-2, $3^{rd}$ musical attribute 1008-3, and $4^{th}$ musical attribute 1008-4.

Affinity calculating engine 414 may determine an affinity subvalue 1010 for each possible segment pairing and for each musical attribute 1008. For instance, affinity subvalues 1010 may be determined for every possible pairing between $1^{st}$ musical segment 1002 and all other musical segments, e.g., $2^{nd}$ and $3^{rd}$ musical segments 1004 and 1006. This may be repeated for each musical attribute 1008. Accordingly, $1^{st}$ musical segment 1002 may have eight affinity subvalues 1010A-1010H associated with $1^{st}$ musical segment 1002. In embodiments, the eight affinity subvalues 1010A-1010H may be linked or appended to $1^{st}$ musical segment 1002 to form $1^{st}$ musical segment and affinity values 806-1 and stored in new segments library 804 as discussed in FIG. 8.

Although FIG. 10A illustrates calculating affinity subvalues 1010 for only $1^{st}$ musical segment 1002, it is to be appreciated that this calculation may be performed for all other musical segments, such as $2^{nd}$ musical segment 1004 and $3^{rd}$ musical segment 1006. Corresponding affinity subvalues may also be linked or appended to $2^{nd}$ and $3^{rd}$ musical segments 1004 and 1006 in musical segments library 504 in FIG. 8, and then stored in new segments library 804.

As shown in FIG. 10B, exemplary affinity values, such as affinity value 608 in FIG. 9, are calculated according to certain affinity rules, such as affinity rules 1012, 1014, and 1016. Affinity rules 1012, 1014, and 1016 may each have different selected musical attributes. For instance, affinity rule 1012 may have $1^{st}$ musical attribute 1008-1 selected, affinity rule 1014 may have $1^{st}$ and $2^{nd}$ musical attributes 1008-1 and 1008-2 selected, and affinity rule 1016 may have $1^{st}$, $2^{nd}$, and $3^{rd}$ musical attributes 1008-1, 1008-2, and 1008-3 selected. As aforementioned herein, the musical attributes may be selected by a user or be programmed to be selected by default.

According to affinity rule 1012, only one musical attribute is selected: $1^{st}$ musical attribute 1008-1. Thus, the affinity value for affinity rule 1012 is calculated to be the corresponding affinity subvalue since there is no other affinity subvalue with which to add. Accordingly, the affinity value for $1^{st}$ and $2^{nd}$ musical segments 1002 and 1004 is 0.8, as shown by affinity subvalue 1010A in FIG. 10A. The affinity value for $1^{st}$ and $3^{rd}$ musical segments 1002 and 1006 is 0.2.

Based upon affinity rule 1014, two musical attributes are selected: $1^{st}$ and $2^{nd}$ musical attributes 1008-1 and 1008-2. Thus, the affinity value for affinity rule 1014 is calculated as the multiplication of corresponding affinity subvalues for each attribute for the segment pair. For instance, the affinity value for $1^{st}$ and $2^{nd}$ musical segments 1002 and 1004 is 0.08, which is the multiplication of affinity subvalue 1010A (0.8) and 1010C (0.1). The affinity value for $1^{st}$ and $3^{rd}$ musical segments 1002 and 1006 is 0.18, which is the multiplication of affinity subvalues 1010B (0.2) and 1010D (0.9).

Furthermore, according to affinity rule 1016, three musical attributes are selected: $1^{st}$, $2^{nd}$, and $3^{rd}$ musical attributes 1008-1, 1008-2, and 1008-3. As a result, the affinity value for $1^{st}$ and $2^{nd}$ musical segments 1002 and 1004 is 0.056, which is the multiplication of affinity subvalues 1013A (0.8), 1010C (0.1), and 1010E (0.7). The affinity value for $1^{st}$ and $3^{rd}$ musical segments 1002 and 1006 is 0.072, which is the multiplication of affinity subvalues 1010B (0.2), 1010D (0.9), and 1010F (0.4).

Each of affinity rules 1012, 1014, and 1016 are examples of how different affinity rules 410 may result in different affinity subvalues 1010. Depending on what the user selects, or what is selected by default, affinity subvalues 1010 may vary. Accordingly, a user may change the set of affinity rules to achieve different musical compositions. According to embodiments, musical compositions may be generated by a composer engine, as will be discussed further herein. It is to be appreciated that the scale shown in FIGS. 10A and 10B are merely exemplary, and that other embodiments are not limited to such scoring schemes.

V. Composer Engine

The musical segments and affinity subvalues may be received by a composer engine. The composer engine may be lines of program code stored on a memory device configured to be executed by a processor to perform a specific function. In embodiments, the composer engine may be configured to generate a musical composition. The musical composition may be generated by arranging a plurality of musical segments together into a musical piece. The musical segments may be arranged according to affinity values determined by a set of affinity rules, such as affinity rules 410.

Figure 11:
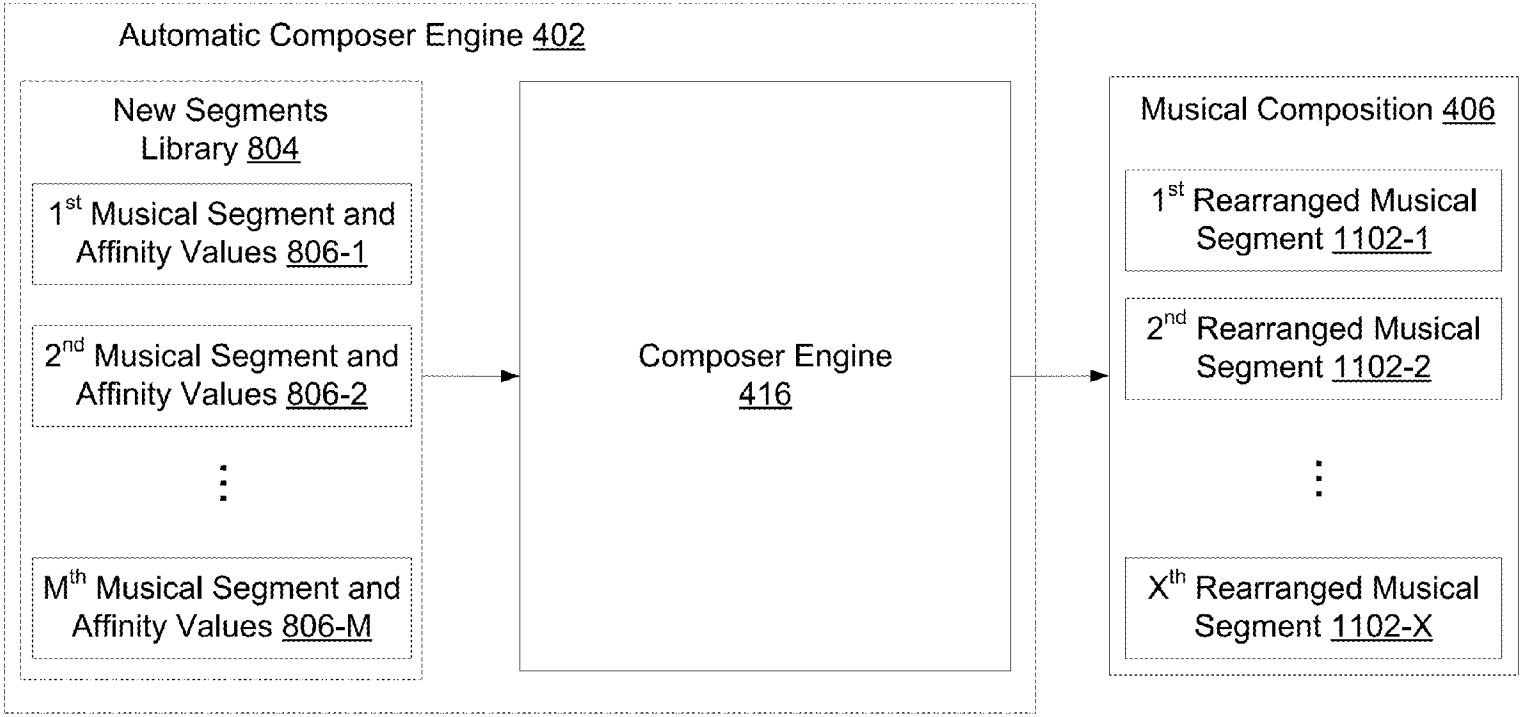
FIG. 11 is a block diagram illustrating a composer engine for an automatic composer, according to embodiments of the present invention.

FIG. 11 is a simplified block diagram illustrating an exemplary composer engine, such as composer engine 416, according to embodiments of the present invention. Composer engine 416 may receive musical segments and affinity values 806 from new segments library 804 and subsequently arrange them into a musical composition 406. In embodiments, musical composition 406 includes a plurality of rearranged musical segments 1102. Each rearranged musical segment 1102 may be a musical segment 806 from new segments library 804 arranged differently than when musical segment 806 was arranged as a portion of its music performance data.

According to embodiments, musical composition 406 may be generated by rearranging musical segments 1106 from new segments library 1104 based upon affinity values, e.g., affinity values 1102 in FIG. 11, calculated according to a set of affinity rules, e.g., affinity rules 410 in FIG. 11. Composer engine 416 may analyze the affinity values for each musical segment, i.e., musical segment and affinity values 1106. Composer engine 416 may then pair together musical segments having a predetermined affinity value. For instance, composer engine 416 may combine musical segments 1106 having an affinity value greater than a certain threshold affinity value, or composer engine 416 may combine musical segments 1106 having a highest affinity value. Combining those musical segments having predetermined affinity values results in a music composition whose rearranged musical segments 1102 may be similar to one another in musical sound such that the resulting composition is a cohesive musical piece.

As mentioned herein, an affinity value may be a number that reflects a similarity of two musical segments based upon selected affinity rules. Thus, depending on the selection of affinity rules, musical composition 406 may be arranged such that its rearranged musical segments 1102-1 through 1102-X have a strong similarity between those musical attributes selected in the affinity rules. In other words, the selected affinity rules may dictate how the musical compositions will sound. For example, if the set of affinity rules select chord progression and harmonic scale as the selected musical attributes, then musical segments 1102 arranged in musical composition 406 will be have similar chord progression and harmonic scale.

Figure 12:
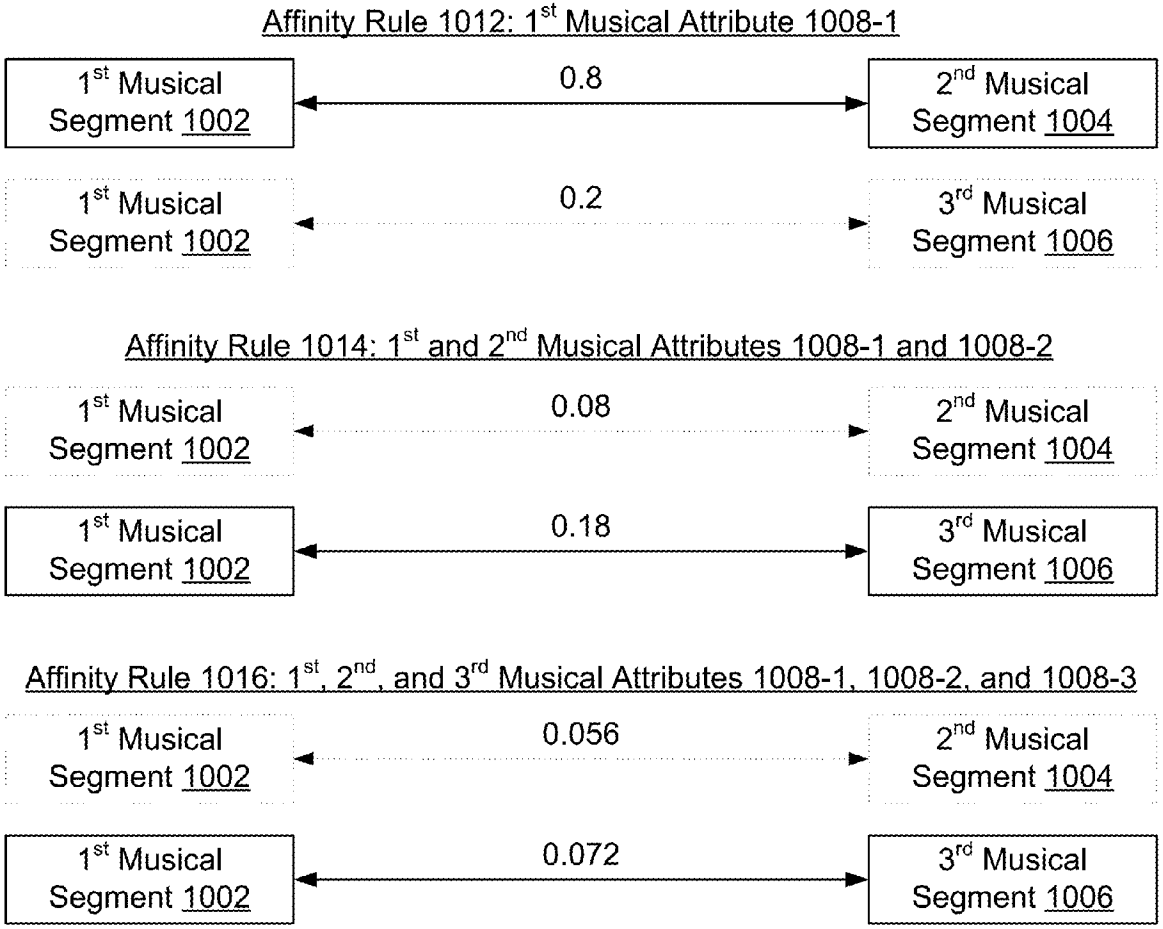
FIG. 12 is a diagram illustrating selecting musical segment pairs having a predetermined value, according to embodiments of the present invention.

To ensure that the rearrangement musical segments 1102 are similar to one another in musical sound, composer engine 416 may generate musical composition 406 may pairing musical segments having a highest affinity value, as discussed in FIG. 12 herein.

A. Pairing Segments

Composer engine 416 may generate musical compositions by rearranging a plurality of musical segments. Rearranging musical segments may be performed by generating a series of pairs of musical segments. To determine which two musical segments pair well together, composer engine 416 may analyze affinity values for each possible pair and pair together those musical segments having the highest affinity value.

FIG. 12 is a block diagram illustrating an example pairing of musical segments by composer engine 416. The example illustrated in FIG. 12 may be a continuation of the example discussed in FIG. 10B. In this example, there may be only two possible pairs for $1^{st}$ musical segment 1002: a pairing with $2^{nd}$ musical segment 1004 or a pairing with $3^{rd}$ musical segment 1006. This may be because there are only three musical segments in this example. Thus, $1^{st}$ musical segment 1002 can only be paired with either $2^{nd}$ musical segment 1004 or $3^{rd}$ musical segment 1006. It is to be appreciated that embodiments having more musical segments may result in a greater number of possible pairs.

As shown in FIG. 12, several different possible pairings are illustrated according to sets of affinity rules. Based upon affinity rule 1012, the affinity value between $1^{st}$ musical segment 1002 and $2^{nd}$ musical segment 1004 is 0.8, as discussed herein with respect to FIG. 10B, and the affinity value between $1^{st}$ musical segment 1002 and $3^{rd}$ musical segment 1006 is 0.2. Because $1^{st}$ musical segment 1002 has a higher affinity value with $2^{nd}$ musical segment 1004, composer engine 416 may pair $1^{st}$ musical segment 1002 with $2^{nd}$ musical segment 1004. Indication of this selection may be illustrated by its solid lines, as opposed to the dotted lines for the pairing of $1^{st}$ musical segment 1002 with 3rd musical segment 1006.

According to affinity rule 1014, the affinity value between $1^{st}$ musical segment 1002 and $2^{nd}$ musical segment 1004 is 0.08, and the affinity value between $1^{st}$ musical segment 1002 and $3^{rd}$ musical segment 1006 is 0.18. Thus, composer engine 416 may pair $1^{st}$ musical segment 1002 with 3rd musical segment 1006. Furthermore, based upon affinity rule 1016, the affinity value between $1^{st}$ musical segment 1002 and $2^{nd}$ musical segment 1004 is 0.056, and the affinity value between $1^{st}$ musical segment 1002 and $3^{rd}$ musical segment 1006 is 0.072. As a result, composer engine 416 may pair $1^{st}$ musical segment 1002 with $3^{rd}$ musical segment 1006.

FIGS. 6-12 illustrate composer engine 416 as determining a pairing of musical compositions based upon a multiplication of affinity subvalues. One skilled in the art understands that this is merely one embodiment, and that other embodiments are not limited to such calculations. As already discussed herein, the affinity value may be a normalized value. Additionally, in other embodiments, the affinity value may be an average of affinity subvalues, a mean of affinity subvalues, or any other way of using mathematics to distinguish one value from a plurality of values.

B. Exemplary Musical Composition

According to embodiments, the series of matched pairs may then be arranged into a musical composition. The musical composition may be formed by utilizing the same techniques as discussed herein with regard to pairing musical segments. That is, one musical segment of a pair of musical segments may pair with another musical segment of another pair of musical segments. Thus, a musical composition may be seen as a partially overlapping arrangement of pairs of musical segments, as will be shown herein with respect to FIGS. 13A and 13B.

Figure 13A:
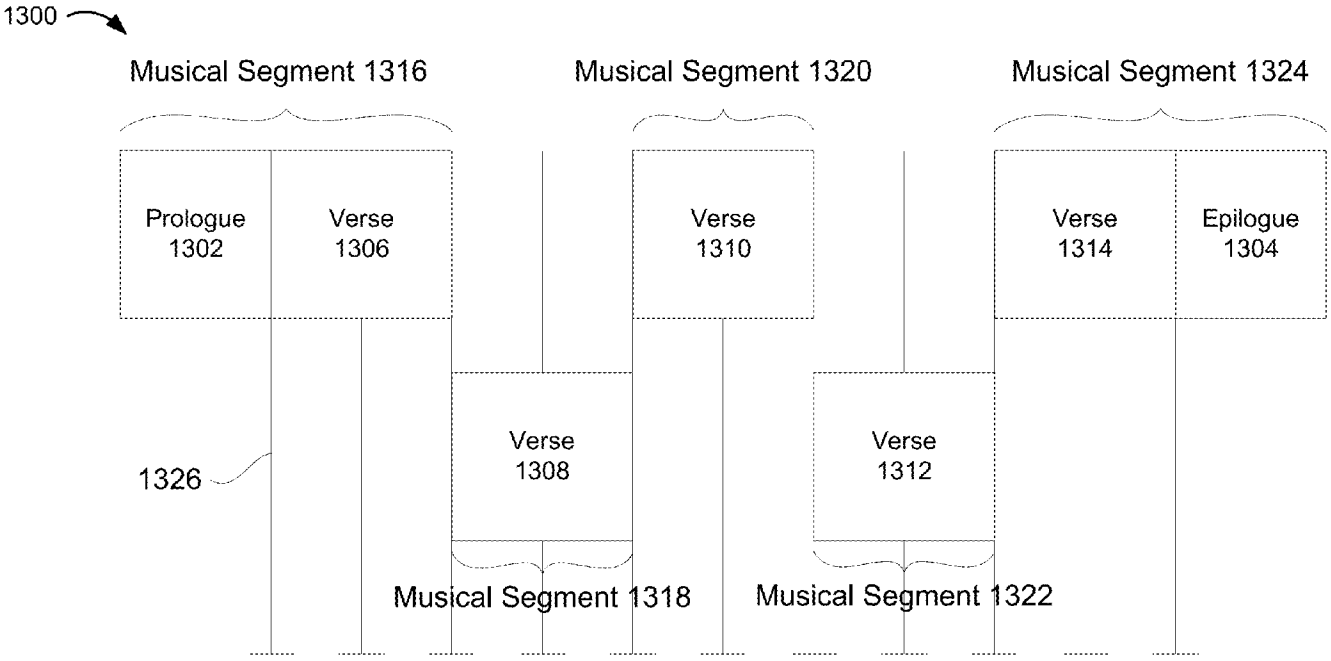
FIGS. 13A and 13B are diagrams illustrating musical compositions, according to embodiments of the present invention.

FIG. 13A illustrates an exemplary musical composition 1300 as generated by automatic composer 402. Exemplary musical composition 1300 may be one embodiment of musical composition 406 discussed in FIG. 4. As shown, musical segments 1316 may include different arrangements of prologues, epilogues, and verses as mentioned herein. For instance, musical segment 1316 includes a prologue 1302 and a verse 1306, musical segment 1324 includes a verse 1314 and an epilogue 1304, and musical segments 1320, 1318, and 1322 include only verses 1308, 1310, and 1312, respectively.

Musical segment 1316 is paired with musical segment 1318. Composer engine 416 may have paired them together based upon an affinity value calculated based upon a set of affinity rules, as discussed herein. To form an entire musical piece, composer engine 416 may build upon that pair by forming another pair between musical segment 1318 and 1320. Accordingly, musical segment 1318 may be shared between two separate pairs of musical segments to form a portion of musical composition 1300. Thus, there may be a partially overlapping arrangement between pairs of musical segments throughout musical composition 1300 where each musical segment has a high affinity value with adjacent musical segments. Arranging the musical segments to have a high affinity value with adjacent musical segments may result in similar sounds across musical segments throughout musical composition 1300, thereby appearing as a single well composed and cohesive musical piece.

It is to be appreciated that musical segments 1316, 1318, 1320, 1322, and 1324 may each be different from one another, or some may be the same. For example, musical segment 1318 may be different than every other musical segment such that each musical segment has its own distinctive arrangement of musical notes. However, in other examples, musical segment 1318 may be repeated. That is, musical segment 1322 may be a copy of musical segment 1320 such that verse 1312 is the same as verse 1310. The same applies to a series of musical segments where two or more sequential musical segments are repeated. This repeating may be referred to as "looping".

FIG. 13A illustrates musical composition 1300 against a musical bar backdrop 1326 to show how the musical framework of each musical segment may be substantially similar. This similarity may be established by a set of segment creation rules, such as segment creation rules 408 in FIGS. 1 and 2, that determines how music performance data is to be segmented by a segment creator engine, e.g., segment creator engine 412. In embodiments, musical segments 1316, 1318, 1320, 1322, and 1324 are shown vertically offset from one another to make it easier to perceive the distinctive musical segments. The musical segments, however, can be arranged in other ways. For instance, the musical segments can be arranged to be directly adjacent to one another as shown in FIG. 13B.

Figure 13B:
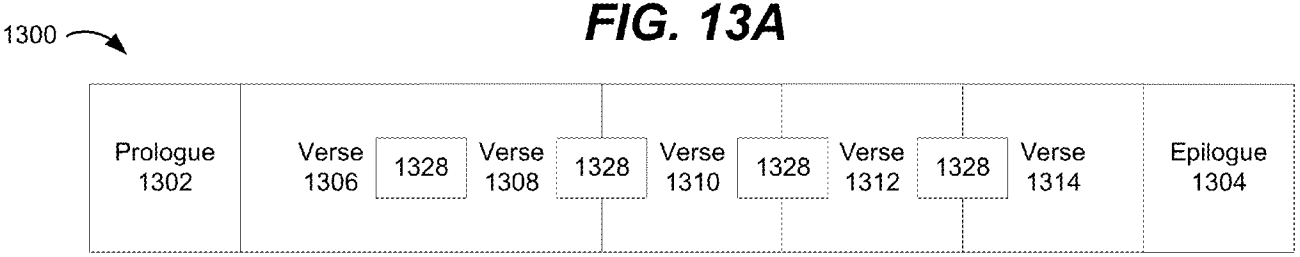

FIG. 13B illustrates musical composition 1300 in a linear format where each musical segment is arranged directly adjacent to one another. In embodiments, transitions 1328 may be positioned between musical segments such that each transition 1328 is between each verse. Transitions 1328 may minimize any audible disjointedness between musical segments created by joining two musical segments with one another that were not originally created as such. In certain embodiments, transitions 1328 may be a cross-fade. As a cross-fade, transitions 1328 may fade out of one verse while simultaneously turning up another verse at the interface of both verses. For instance, verse 1306 may fade out while verse 1308 turns up at the first transition 1328. In embodiments, transitions 1328 is an overlapping/combination of transitions 614 and 616 discussed in FIG. 6D.

C. Sources for Generating a Musical Composition

According to embodiments, an automatic composer can generate a musical composition from music performance data, and analysis data. The automatic composer generates the musical composition by segmenting the music performance data into musical segments and stores them in a segment library. The automatic composer then takes musical segments from the segment library and combines them into the musical composition. The musical composition may be a musical piece that is arranged differently than the music performance data.

Figure 14A:
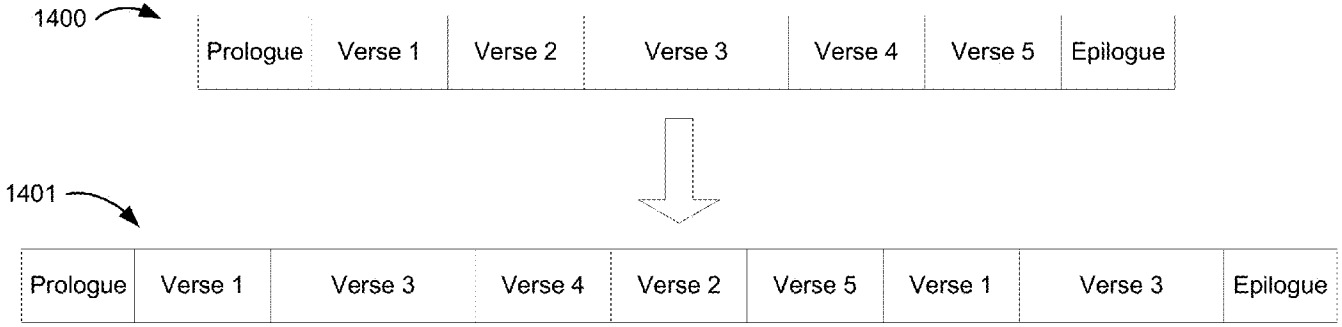
FIG. 14A is a diagram illustrating generation of a musical composition from one music performance data, according to embodiments of the present invention.

FIG. 14A illustrates an exemplary music performance data 1400 and an exemplary musical composition 1401 generated by an automatic composer, such as automatic composer 402, according to embodiments of the present invention. In this example, music performance data 1400 includes one musical piece having a prologue, an epilogue, and a plurality of verses 1-5 in sequential order. The prologue, epilogue, and verses 1-5 may be parts of musical segments as discussed herein with respect to FIG. 4B. Thus, one skilled in the art understands that although FIG. 14A shows a prologue, an epilogue, and verses 1-5, the illustration applies to musical segments as well.

Music performance data 1400 may be segmented and rearranged by the automatic composer to generate musical composition 1401. In embodiments, musical composition 1401 may include verses 1-5 but rearranged to be in a different order than how they were arranged as music performance data 1400. Additionally, verses, such as verse 1 and verse 3, may be repeated in other parts of musical composition 1401. As a result, musical composition 1401 may be a musical piece that has an arrangement of verses 1-5 in a particular order that may be entirely new and unique.

In embodiments where music performance data includes more than one musical piece, the resulting musical composition may include segments from more than one musical piece. For instance, music performance data 1402 may include two musical pieces: first musical piece 1402A and second musical piece 1402B, each having a prologue, an epilogue, and a plurality of verses 1-5 in sequential order. Second musical piece 1402B is shaded to indicate which prologue, epilogue, and verse belongs to second musical piece 1402B. Music performance data 1402 may be segmented and rearranged by the automatic composer to generate musical composition 1403. In embodiments, musical composition 1403 may include verses 1-5 from both music performance data 1402A and 1402B but rearranged to be in a different order than how they were originally arranged before being recomposed by the automatic composer. As a result, musical composition 1401 may be a musical piece that has an arrangement of one or more verses 1-5 from both music performance data 1402A and 1402B in a particular order that may be entirely new and unique.

Figure 14B:
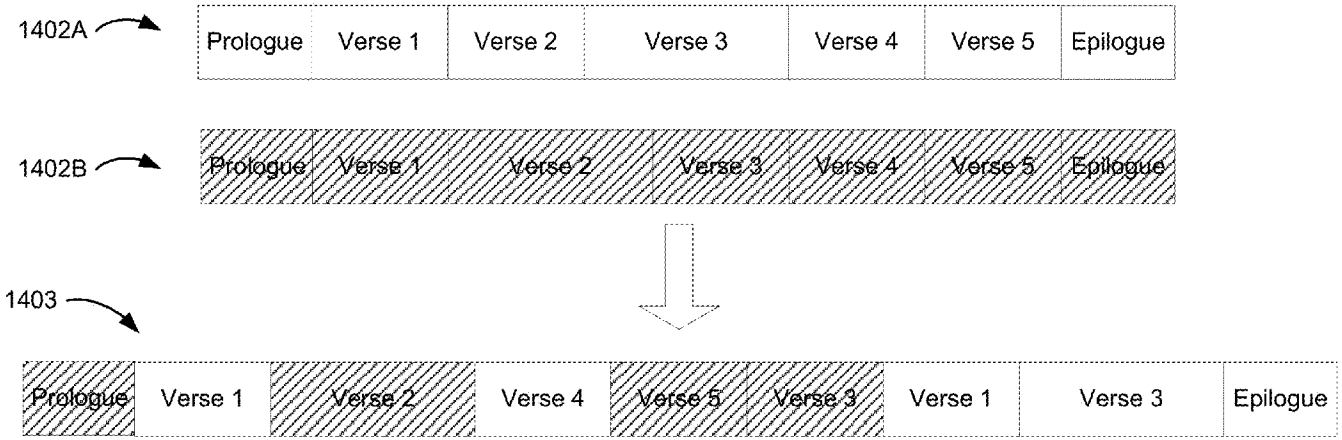
FIG. 14B is a diagram illustrating generation of a musical composition from two different music performance data, according to embodiments of the present invention.

Although FIG. 14B illustrates music performance data 1402 has including two separate music performance data 1402A and 1402B as sources for generating a musical composition 1403, embodiments are not limited to such sources. For example, a segments library may contain musical segments created from other music performance data that have been segmented at a different period of time. These segments may be used by the automatic composer to generate a musical composition, according to embodiments of the present invention.

VI. Method of Automatically Composing a Song

Figure 15:
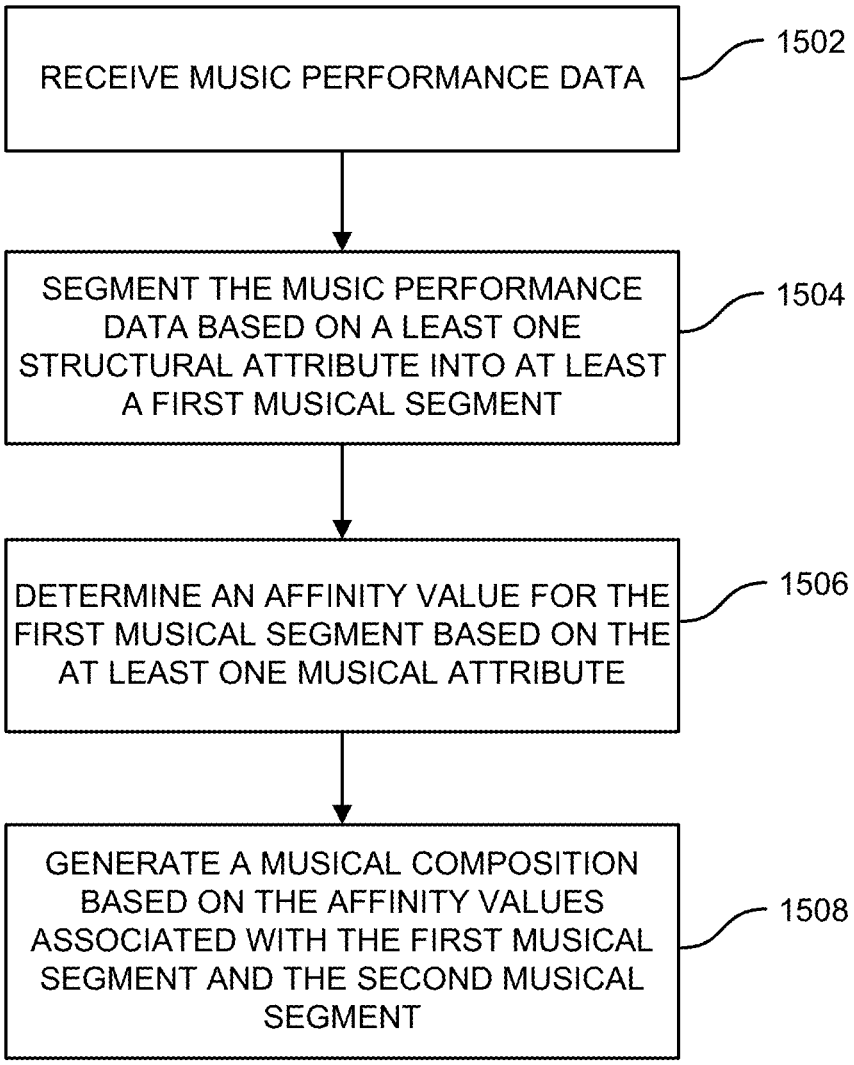
FIG. 15 is a flow chart for a method of generating a musical composition, according to embodiments of the present invention.

FIG. 15 is a flow chart illustrating a method for generating a musical composition from music performance data, according to embodiments of the present invention. At block 1502, music performance data and analysis data may be received by a processor. The processor may contain code for an automatic composer, such as automatic composer 402 discussed herein. In embodiments, music performance data may be received by a segment creator engine of the automatic composer engine. As an example, segment creator engine 415 may receive music performance data 404 as discussed herein with respect to FIG. 4. In embodiments, music performance data 404 includes analysis data pertaining to melody, harmony, and rhythm of music performance data 404.

At block 1504, the music performance data may be segmented based on at least one structural attribute into at least a first musical segment. For instance, the music performance data may be segmented by the segment creator engine, such as segment creator engine 415 discussed herein. The structural attribute may be a property of the music performance data relating to the underlying musical framework of a musical piece, such as number of bars, chord sequences, rhythmic structure, spectral similarity over time, baseline similarity, and the like.

In embodiments, the first musical segment may be associated with at least one musical attribute. A musical attribute may include properties of a musical segment that relate to how the musical segment sounds. For instance, musical attributes may be characteristics such as, but not limited to, chord progression, spectral content, beats, rhythm, and harmonic scale. Musical attributes may differ from structural attributes in that musical attributes may relate to the arrangement of tones, melodies, chords, harmonies, and the like of a musical piece, while structural attributes may relate to the underlying musical framework of a musical piece.

In embodiments, the first musical segment may have at least one of a corresponding prologue, epilogue, and a verse. A prologue may be a portion of an audio file that is devoid of musical data. Additionally, a prologue may be a portion of an audio file that immediately precedes a portion of an audio file that has melody, harmony, or rhythm. An epilogue may also be a portion of an audio file that is devoid of musical data. However, in contrast to a prologue, an epilogue may be a portion of an audio file that immediately follows a portion of an audio file that has melody, harmony, or rhythm. In contrast to both a prologue and an epilogue, a verse is a portion of an audio file that has musical data. A verse may be a rift, a chorus, a solo piece, and the like.

At block 1506, an affinity value for the first musical segment may be determined based on the at least one musical attribute. The affinity value may represent a degree of similarity between the first musical segment and a second musical segment having the at least one musical attribute. In embodiments, the affinity value is calculated by an affinity calculating engine, such as affinity calculating engine 414 in FIG. 4. The affinity calculating engine may receive the musical segments and calculate affinity values for each possible musical segment pairing. The affinity calculating engine may include a plurality of affinity functions where each affinity function is configured to calculate an affinity subvalue for a particular musical attribute. The affinity subvalue may be number reflecting a degree of similarity between the particular musical attribute of two musical segments.

An affinity value may be calculated by referencing the affinity subvalues for musical attributes selected in a set of affinity rules. The set of affinity rules may contain a selection of musical attributes that is desired to be shared between the first and second musical segments in a resulting musical composition. In embodiments, the affinity value may be calculated by adding together the affinity subvalues for the musical attributes selected in the set of affinity rules.

At block 1508, a musical composition may be generated based upon the affinity values associated with the first musical segment and the second musical segment. In embodiments, a composer engine, such as composer engine 416, generates the musical composition. The composer engine may pair segments with one another having a highest affinity value. Combining those musical segments having predetermined affinity values results in a music composition whose rearranged musical segments may be similar to one another in musical sound such that the resulting musical composition is a cohesive musical piece In embodiments, the musical composition may be presented to a user. For example, the musical composition may be outputted to a user interface from which the user may see and hear the musical composition. Additionally, the user interface may allow the user to interact with the automatic composer to generate inputs for establishing segment creation rules 408 and selecting affinity rules, as discussed herein. Examples of such a user interface is shown herein with respect to FIGS. 16A-16C.

VII. User Interface

Figure 16A:
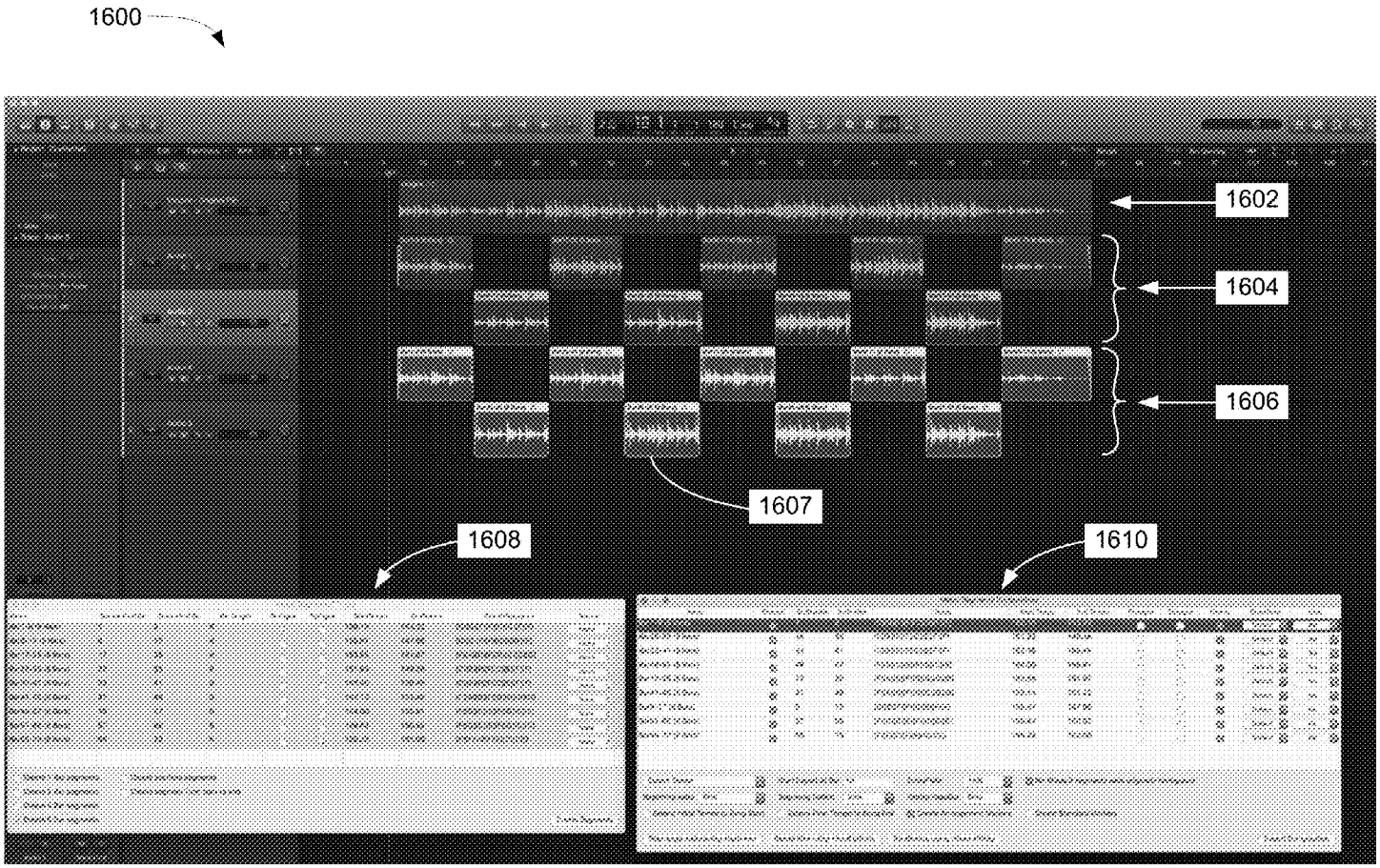
FIGS. 16A-16C illustrate windows for a user interface for an automatic composer, according to embodiments of the present invention.

FIG. 16A is a screenshot of an exemplary user interface 1600 for an automatic composer, i.e., automatic composer 402, according to embodiments of the present invention. User interface 1600 may be a program window displayed on a display screen of a computing device, such as a computer, tablet, laptop, smartphone, and the like. The automatic composer may be a program executed by a processor. The processor may be coupled to the display screen such that the processor may present user interface 1600 to the user.

User interface 1600 may provide information to a user via visual output showing music performance data as well as outputted musical compositions. For example, user interface 1600 shows a music performance data 1602. Music performance data 1602 may be an audio file for a musical piece. The musical piece may be a live recording of a musical performance, or a stored audio file of a musical piece. Music performance data 1602 may be presented to the user such that the user may reference music performance data 1602 when comparing it to music compositions generated by the automatic composer.

As shown in FIG. 16A, two musical compositions are shown: a first musical composition 1604, and a second musical composition 1606. In embodiments, first and second musical compositions 1604 and 1606 may be generated by the automatic composer and subsequently presented to the user via user interface 1600. In the example shown in FIG. 16A, first musical composition 1604 may be a first order of musical composition that occurred before second musical composition 1604. First musical composition 1604 may be a segmented version of music performance data 1602 in its original order. First musical composition 1604 may be in its original order to illustrate how music performance data 1602 is segmented.

Second musical composition 1606 may be a second order of musical composition that occurred after the generation of first musical composition 1604. Second musical composition 1606 may be a rearranged version of music performance data 1602 including a plurality of musical segments 1607. Each musical segment 1607 of music performance data 1606 may be a portion of music performance data 1602 that is arranged in a different location than when it originally was presented as music performance data 1602. Each rearranged musical segment 1607 in second musical composition 1606 may have a high affinity with one another such that second musical composition 1606 is a cohesive musical piece.

The user may control how musical composition 1606 is arranged and structured by interacting with interactive windows, such as segmentation window 1608 and composer window 1610. Segmentation window 1608 and composer window 1610 may allow a user to input information for determining segment creation rules, such as segment creation rules 408, and affinity rules, such as affinity rules 410. Details of segmentation window 1608 and composer window 1610 will be discussed further herein with respect to FIGS. 16B and 16C, respectively.

A. Segmentation Window

Figure 16B:
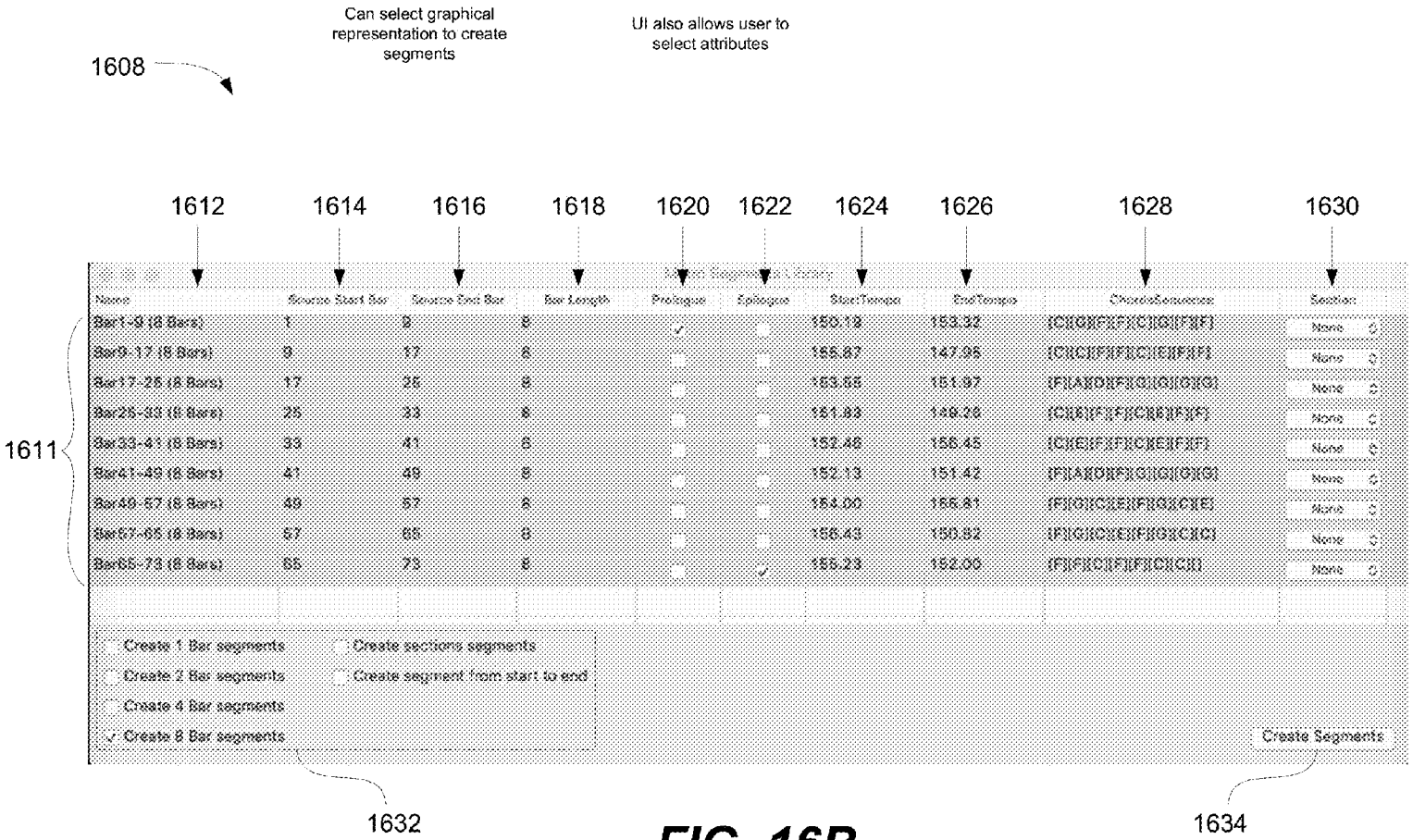

FIG. 16B shows an enlarged view of segmentation window 1608. In embodiments, segmentation window 1608 may allow a user to initiate creation of musical segments of music performance data 1602, and subsequently display pertinent information relating to each musical segment to the user. Segmentation window 1608 may include a segment creator region 1632 within which a plurality of options may be presented to a user. Each option may specify one or more segment creation rules, such as segment creation rules 408, upon which segmenting music performance data 1602 may be based. As shown in the example illustrated in FIG. 16B, segment creator region 1632 may be a plurality of radio buttons selectable by a user. The user may select one or more radio buttons associated with the desired segment creation rule and initiate creation of the musical segments by pressing a clickable button, such as a clickable button labeled "Create Segments" 1634. Once the button is clicked, segmentation window 1608 may display pertinent information relating to the created musical segments.

In embodiments, segmentation window 1608 may display the pertinent information in a plurality of rows and columns, where each row conveys information pertaining to a specific musical segment and each column conveys information pertaining to various properties of the musical segment. As shown in FIG. 16B, segmentation window 1608 has a plurality of rows 1611, each row relating to a musical segment created from music performance data 1602.

As further shown in FIG. 16B, segmentation window 1608 may have a plurality of columns 1612, 1614, 1616, 1618, 1620, 1622, 1624, 1626, 1628, and 1630. Each column may convey information pertaining to various properties of the musical segment In embodiments. In FIG. 16B, column 1612 may contain names of each musical segment. Each musical segment may be named according to its specific range of bars from music performance data 1602. For example, a first musical segment may be named "Bar1-9 (8 Bars)", as shown in FIG. 16B. However, it is to be appreciated that any other names may be used for naming musical segments.

Columns 1614 and 1616 may contain information pertaining to the start and end bar of each musical segment. For instance, column 1614 may contain a bar number from which a corresponding musical segment starts, and column 1616 may contain a bar number at which the corresponding musical segment ends. Column 1618 may contain information pertaining to a bar length of a musical segment. As shown in FIG. 16B, column 1618 may include the number "8" showing that the musical segments each contain eight bars, which correlates with the segment creation rules from which they were originally created already discussed herein.

Columns 1620 and 1622 may contain radio buttons showing which musical segments contain a prologue and an epilogue. Radio buttons that are checked in column 1620 may indicate that a prologue exists in the musical segment. Additionally, radio buttons that are checked in column 1622 may indicate that an epilogue exists in the musical segment. Columns 1624 and 1626 may contain information pertaining to tempo. Specifically, column 1624 may contain information relating to a start tempo of a musical segment, and column 1626 may contain information relating to an end tempo of a musical segment.

Column 1628 may contain information pertaining to a chord sequence of a musical segment. For instance, column 1628 may contain a series of letters in a specific order, representing chords arranged in a specific sequence. Displaying the chord sequence of a musical segment may allow a user to visually perceive the chord sequence. Thus, the user may visually rearrange musical segments without having to hear the chord sequence.

Column 1630 may contain information pertaining to a section for a musical segment. The section may refer to a specific part of a musical piece. For example, the section may refer to an introduction, a chorus, or any other part of a musical piece. Each section may be generically labeled, such as "section A," "section B," section C," and the like.

In addition to using segmentation window 1608 to create musical segments, a user may create musical segments by interacting with music performance data 1602 displayed in the user interface. For instance, the user may click and drag a region of music performance data 1602 to create a musical segment containing the selected region. Additionally, the user may create musical segments by editing musical segments created through segmentation window 1608.

Although FIG. 16B illustrates columns 1612, 1614, 1616, 1618, 1620, 1622, 1624, 1626, 1628, and 1630, embodiments are not limited to such columns, nor are they limited to the information presented by the columns. As an example, more or less columns may be implemented in segmentation window 1608. Additionally, more or less information may be presented by the columns. Furthermore, more or less options may be provided in the segment creator region 1632.

B. Composer Window

Figure 16C:
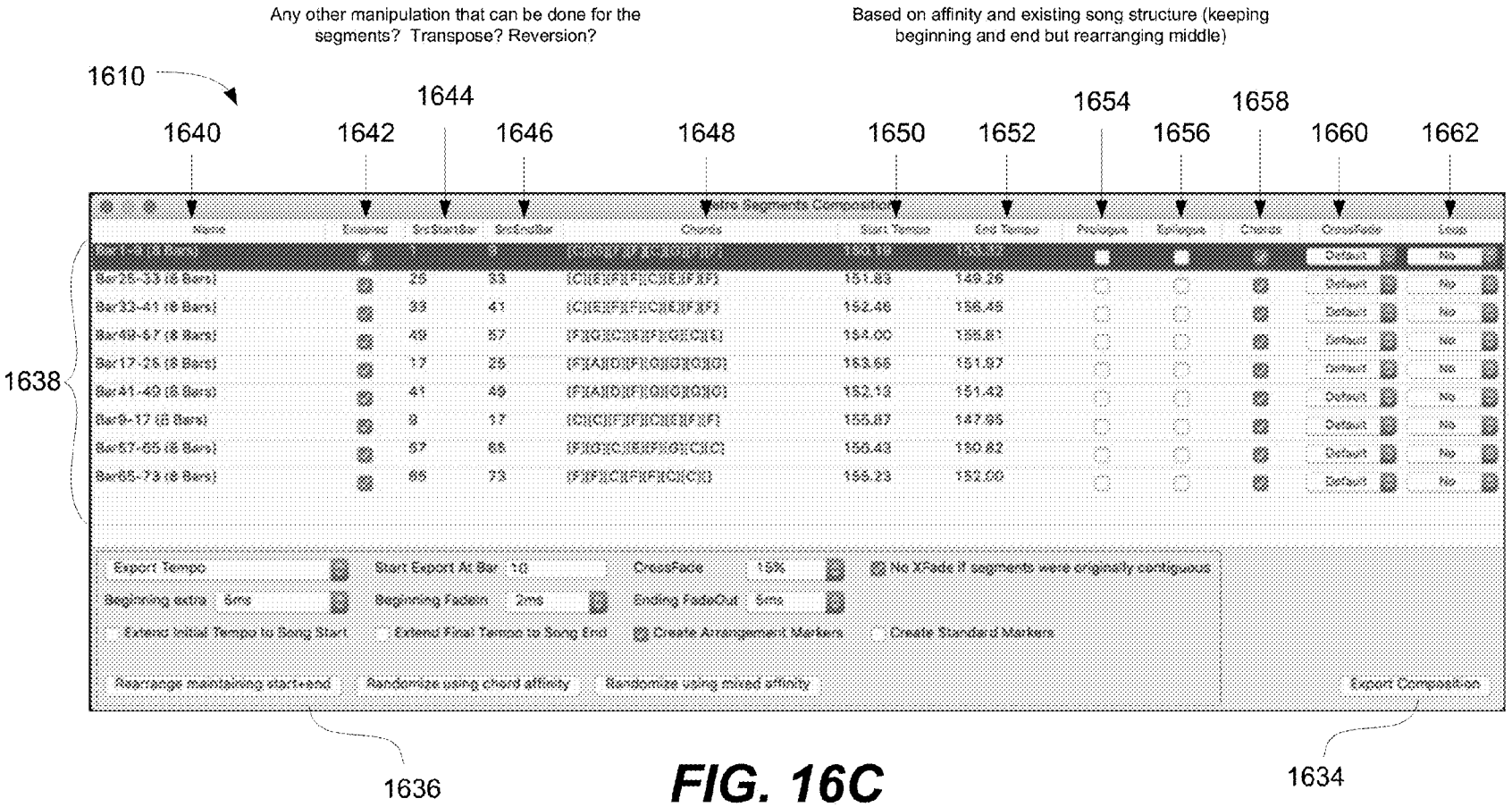

FIG. 16C shows an enlarged view of composer window 1610. In embodiments, composer window 1608 may allow a user to initiate creation of a musical composition, such as musical composition 406, and subsequently present the musical composition to the user. Like segmentation window 1608, composer window 1610 may display pertinent information for musical segments in a plurality of rows and columns, where each row conveys information pertaining to a specific musical segment and each column conveys information pertaining to various properties of the musical segment.

As shown in FIG. 16C, composer window 1610 has a plurality of rows 1638. As already mentioned herein, each row may represent a musical segment. Rows 1638 may represent an arrangement of a musical composition. That is, rows 1638 may be arranged in a sequential order from top to bottom where a top of the order represents the beginning of the musical composition and the bottom represents an ending of the musical composition. In some embodiments, each row may be placed in composer window 1610 by clicking-and-dragging the desired rows (i.e., musical segments) from segmentation window 1608. In other embodiments, each row may be placed in composer window 1610 by uploading a file containing rows 1638.

As further shown in FIG. 16B, segmentation window 1608 may have a plurality of columns 1640, 1642, 1644, 1616, 1648, 1650, 1652, 1654, 1656, 1658, 1660, and 1662, many of which are similar to those discussed herein with respect to FIG. 16B showing segmentation window 1608. For instance, columns 1640, 1644, 1616, 1648, 1650, 1652, 1654, and 1656 are similar to columns 1612, 1614, 1616, 1628, 1624, 1626, 1620, and 1622 in FIG. 16B, respectively. Column 1642 may contain information regarding whether a musical segment is to be enabled or disable. Enabling/disabling segments provide a quick way to omit one or more segments, where enabling the segment includes the segment and disabling the segment excludes the segment from the musical composition.

Column 1658 may contain information regarding whether the chord progression of the segment should be shown. The chord progression may be the same information shown in column 1628. If shown, the user may be able to reference the chord progression in the composer window for ease of reference.

Column 1660 may contain pulldown menus regarding whether a crossfade is implemented for a musical segment. A crossfade may be a transition, such as transition 1028 discussed herein with respect to FIG. 10B, for smoothing a transition between two musical segments to enhance cohesiveness of the musical composition. In embodiments, a user may interact with each pulldown menu to effectuate implementation of a crossfade.

Column 1662 may contain pulldown menus regarding whether a loop is implemented for a musical segment. When the pulldown menu indicates that the musical segment is a loop, it may convey to a user that the musical segment is going to be repeated multiple times in a row in the musical composition. In embodiments, a user may interact with each pulldown menu to indicate whether a musical segment is a duplicate of another musical segment should be repeated in a row or not (and eventually how many times it should be repeated).

In some embodiments, composer window 1610 also includes a composer region 1636. Composer region 1636 may include various input components, e.g., pulldown menus, radio buttons, and clickable buttons, that allow the user to modify a composition of the musical composition. Each input component may be configured to specify a specific property of the musical compositions. For example, a pulldown menu may determine how much crossfade should be implemented between rearranged musical segments in the musical composition. In another example, a clickable button may allow a user to randomly rearrange the musical segments based upon predetermined musical attributes, such as chord affinity and mixed affinity. Once the user has configured the input components of composer region 1636, composer window 1610 may allow the user to export the musical composition by clicking an "Export Composition" button 1634. The musical composition may be exported as an order of an outputted musical compositions as illustrated in FIG. 16A.

FIG. 16C illustrates columns 1640, 1642, 1644, 1616, 1648, 1650, 1652, 1654, 1656, 1658, 1660, and 1662; however, embodiments are not limited to such columns, nor are they limited to the information presented by the columns. As an example, more or less columns may be implemented in composer window 1610. Additionally, more or less information may be presented by the columns. Furthermore, more or less options may be provided in the composer region 1636.

VIII. Computer System

Figure 17:
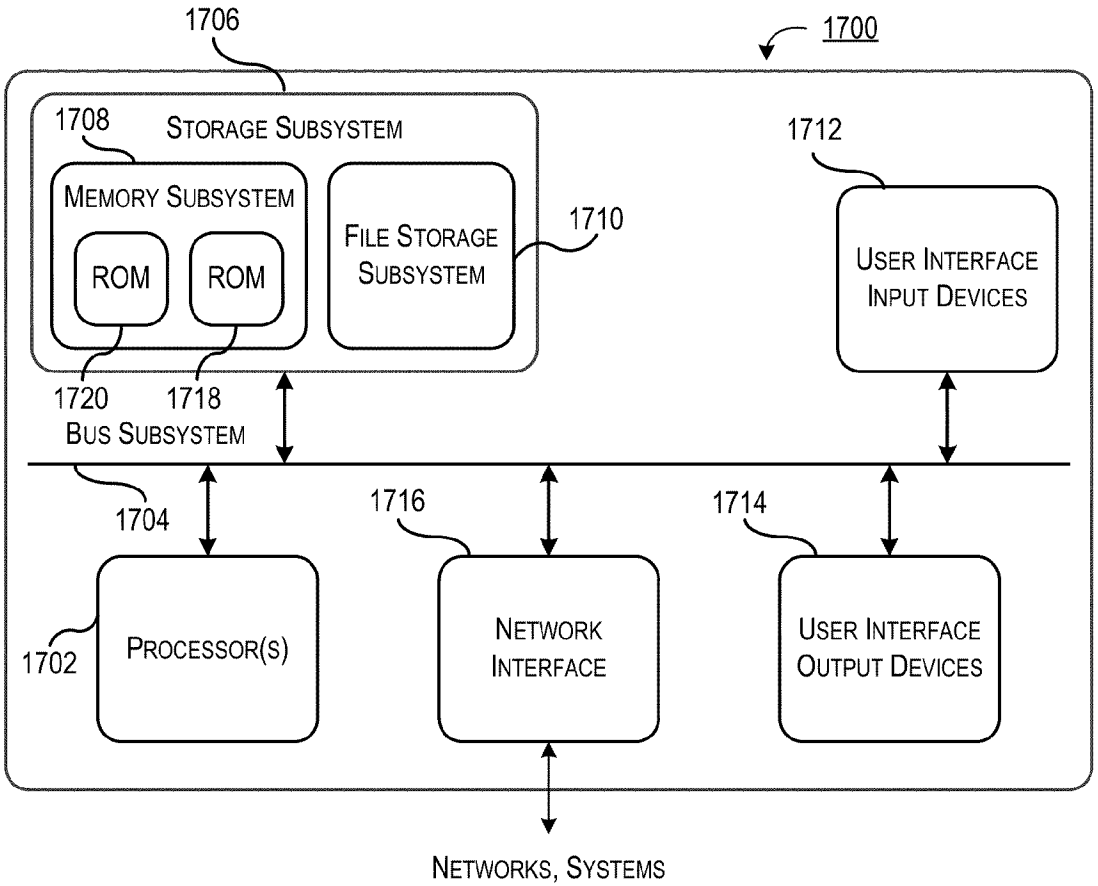
FIG. 17 is a simplified block diagram illustrating a computer system that may incorporate components of various systems and devices described herein, according to embodiments of the present invention.

FIG. 17 is a simplified block diagram depicting a computer system 1700 that may incorporate components of various systems and devices described herein according to certain aspects of the present disclosure. In some cases, a computing device can incorporate some or all of the components of computer system 1700. Computer system 1700 may include one or more processors 1702 that communicate with a number of peripheral subsystems via a bus subsystem 1704. These peripheral subsystems may include a storage subsystem 1706, including a memory subsystem 1708 and a file storage subsystem 1710, user interface input devices 1712, user interface output devices 1714, and a network interface subsystem 1716.

Bus subsystem 1704 can provide a mechanism for allowing the various components and subsystems of computer system 1700 communicate with each other as intended. Although bus subsystem 1704 is shown schematically as a single bus, in some cases, the bus subsystem may utilize multiple busses.

Processor 1702, which can be implemented as one or more integrated circuits (e.g., a conventional microprocessor or microcontroller), controls the operation of computer system 1700. One or more processors 1702 may be provided. These processors may include single core or multicore processors. In some cases, processor 1702 can execute a variety of programs in response to program code and can maintain multiple concurrently executing programs or processes. At any given time, some or all of the program code to be executed can be resident in processor(s) 1702 and/or in storage subsystem 1706. Through suitable programming, processor(s) 1702 can provide various functionalities described above.

Network interface subsystem 1716 provides an interface to other computer systems and networks. Network interface subsystem 1716 serves as an interface for receiving data from and transmitting data to other systems from computer system 1700. For example, network interface subsystem 1716 may enable computer system 1700 to connect to one or more devices via the Internet. In some cases, network interface 1716 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), GPS receiver components, and/or other components. In some cases, network interface 1716 can provide wired network connectivity (e.g., Ethernet) in addition to or instead of a wireless interface.

User interface input devices 1712 may include a keyboard, pointing devices such as a mouse or trackball, a touchpad or touch screen incorporated into a display, a scroll wheel, a click wheel, a dial, a button, a switch, a keypad, audio input devices such as voice recognition systems, microphones, eye gaze systems, and other types of input devices. In general, use of the term "input device" is intended to include all possible types of devices and mechanisms for inputting information to computer system 1700. For example, in an iPhone®, user input devices 1712 may include one or more buttons provided by the iPhone® and a touchscreen which may display a software keyboard, and the like.

User interface output devices 1714 may include a display subsystem, indicator lights, or non-visual displays such as audio output devices, etc. The display subsystem may be a cathode ray tube (CRT), a flat-panel device such as a liquid crystal display (LCD), a projection device, a touch screen, and the like. In general, use of the term "output device" is intended to include all possible types of devices and mechanisms for outputting information from computer system 1700. For example, a software keyboard may be displayed using a flat-panel screen.

Storage subsystem 1706 provides a computer-readable storage medium for storing the basic programming and data constructs that provide the functionality of various aspects disclosed herein. Storage subsystem 1706 can be implemented, e.g., using disk, flash memory, or any other storage media in any combination, and can include volatile and/or non-volatile storage as desired. Software (programs, code modules, instructions) that when executed by a processor provide the functionality described above may be stored in storage subsystem 1706. These software modules or instructions may be executed by processor(s) 1702. Storage subsystem 1706 may also provide a repository for storing data used in accordance with the present invention. Storage subsystem 1706 may include memory subsystem 1708 and file/disk storage subsystem 1710.

Memory subsystem 1708 may include a number of memories including a main random access memory (RAM) 1718 for storage of instructions and data during program execution and a read only memory (ROM) 1720 in which fixed instructions are stored. File storage subsystem 1710 may provide persistent (non-volatile) memory storage for program and data files, and may include a hard disk drive, a floppy disk drive along with associated removable media, a Compact Disk Read Only Memory (CD-ROM) drive, an optical drive, removable media cartridges, and other like memory storage media.

Computer system 1700 can be of various types including a personal computer, a portable device (e.g., an iPhone®, an iPad®, and the like), a workstation, a network computer, a mainframe, a kiosk, a server or any other data processing system. Due to the ever-changing nature of computers and networks, the description of computer system 1700 depicted in FIG. 17 is intended only as a specific example. Many other configurations having more or fewer components than the system depicted in FIG. 17 are possible.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. For example, although certain embodiments have been described with respect to particular process flows and steps, it should be apparent to those skilled in the art that the scope of the present invention is not strictly limited to the described flows and steps. Steps described as sequential may be executed in parallel, order of steps may be varied, and steps may be modified, combined, added, or omitted. As another example, although certain embodiments have been described using a particular combination of hardware and software, it should be recognized that other combinations of hardware and software are possible, and that specific operations described as being implemented in software can also be implemented in hardware and vice versa.

The specification and drawings are, accordingly, to be regarded in an illustrative rather than restrictive sense. Other arrangements, embodiments, implementations and equivalents will be evident to those skilled in the art and may be employed without departing from the spirit and scope of the invention as set forth in the following claims.

What is claimed is:

1. A method comprising:

receiving, by a processor, music performance data;

segmenting, by the processor, the music performance data based on at least one structural attribute into at least a first musical segment, wherein the first musical segment is associated with at least one musical attribute, and wherein the first musical segment has at least one of a corresponding prologue, epilogue, and verse;

determining, by the processor, an affinity value for the first musical segment based on the at least one musical attribute, wherein the affinity value represents a degree of similarity between the first musical segment and a second musical segment having the at least one musical attribute; and generating, by the processor, a musical composition based on the affinity values associated with the first musical segment and the second musical segment.

2. The method of claim 1, wherein the receiving is performed by an automatic composer engine implemented by the processor, the segmenting is performed by a segment creator engine implemented by the processor, the determining is performed by an affinity calculating engine implemented by the processor, and the generating is performed by a composer engine implemented by the processor.

3. The method of claim 1, wherein the second musical segment is segmented from another music performance data different than the music performance data.

4. The method of claim 1, wherein the at least one musical attribute is included in segment creation rules and includes melody, harmony, and rhythm.

5. The method of claim 1, wherein generating the musical composition includes incorporating a transition segment between two successive musical segments.

6. The method of claim 1, wherein affinity rules are user selectable.

7. The method of claim 6, wherein the affinity rules correspond to at least one musical attribute selected from the group consisting of tempo, chord, and tone.

8. The method of claim 1, wherein the affinity value is determined by adding affinity subvalues for two or more different musical attributes.

9. The method of claim 1, wherein generating the musical composition is performed by matching two segments having a predetermined affinity value.

10. The method of claim 1, wherein music data corresponding to the prologue and the epilogue include tones that are devoid of melody, harmony, and rhythm.

11. The method of claim 1, wherein the at least one structural attribute includes a number of musical bars.

12. A non-transitory computer-readable medium having a computer-readable program code configured to cause a processor to perform operations comprising:

receiving music performance data and analysis data;

segmenting the music performance data based on at least one structural attribute into at least a first musical segment, wherein the first musical segment is associated with at least one musical attribute, and wherein the first musical segment has at least one of a corresponding prologue, epilogue, and verse;

determining an affinity value for the first musical segment based on the at least one musical attribute, wherein the affinity value represents a degree of similarity between the first musical segment and a second musical segment having the at least one musical attribute; and generating a musical composition based on the affinity values associated with the first musical segment and the second musical segment.

13. The computer-readable medium of claim 12, wherein the at least one musical attribute is included in segment creation rules and includes melody, harmony, and rhythm.

14. A system comprising:

a user interface;

one or more data processors coupled to the user interface; and one or more non-transitory computer-readable storage media containing instructions configured to cause the one or more data processors to perform operations comprising:

receiving music performance data and analysis data;

segmenting the music performance data based on at least one structural attribute into at least a first musical segment, wherein the first musical segment is associated with at least one musical attribute, and wherein the first musical segment has at least one of a corresponding prologue, epilogue, and verse;

determining an affinity value for the first musical segment based on the at least one musical attribute, wherein the affinity value represents a degree of similarity between the first musical segment and a second musical segment having the at least one musical attribute;

generating a musical composition based on the affinity values associated with the first musical segment and the second musical segment; and presenting the musical composition to the user interface.

15. The system of claim 14, wherein presenting the musical composition comprises arranging the first musical segment and the second musical segment vertically offset from one another.

16. The system of claim 14, wherein presenting the musical composition comprises arranging the first musical segment and the second musical segment directly adjacent to one another.

17. The system of claim 14, wherein in the second musical segment is segmented from another music performance data different than the music performance data.

18. The system of claim 14, wherein the at least one musical attribute is included in segment creation rules and includes melody, harmony, and rhythm.

19. A method comprising:

receiving, by a processor, music performance data;

segmenting, by the processor, the music performance data based on at least one structural attribute into at least a first musical segment, wherein the first musical segment is associated with at least one musical attribute including one of a melody, harmony, rhythm, tempo, or tone, and wherein the first musical segment a prologue, epilogue, or verse;

determining, by the processor, an affinity value for the first musical segment based on the at least one musical attribute, wherein the affinity value represents a degree of similarity between the first musical segment and a second musical segment having the at least one musical attribute; and generating, by the processor, a musical composition based on the affinity values associated with the first musical segment and the second musical segment.

* * * * *